US010472120B2

(12) United States Patent
Cooper et al.

(10) Patent No.: US 10,472,120 B2
(45) Date of Patent: Nov. 12, 2019

(54) CARTON WITH RECLOSABLE TOP

(71) Applicant: Graphic Packaging International, Inc., Atlanta, GA (US)

(72) Inventors: Matt Cooper, Atlanta, GA (US); Aaron Lee Bates, Kennesaw, GA (US); Felicia A. Pinkstone, Aston, PA (US); Gary Lenkeit, Wheaton, IL (US); Ronald E. Hajek, Joliet, IL (US)

(73) Assignee: Graphic Packaging International, LLC, Atlanta, GA (US)

( * ) Notice: Subject to any disclaimer, the term of this patent is extended or adjusted under 35 U.S.C. 154(b) by 127 days.

(21) Appl. No.: 15/422,802

(22) Filed: Feb. 2, 2017

(65) Prior Publication Data

US 2017/0225822 A1 Aug. 10, 2017

Related U.S. Application Data

(60) Provisional application No. 62/291,708, filed on Feb. 5, 2016.

(51) Int. Cl.
*B65D 5/06* (2006.01)
*B65D 5/42* (2006.01)

(52) U.S. Cl.
CPC ..... *B65D 5/062* (2013.01); *B65D 5/42* (2013.01)

(58) Field of Classification Search
CPC ..... B31B 2100/00; B65D 5/70; B65D 5/10; B65D 5/08; B65D 5/064
USPC ..... 229/212, 147, 213
See application file for complete search history.

(56) References Cited

U.S. PATENT DOCUMENTS

| | | | |
|---|---|---|---|
| 83,812 | A | 11/1868 | Wilcox |
| 362,583 | A | 5/1887 | Jordan |
| 567,649 | A | 9/1896 | Lanzit |
| 1,082,868 | A | 12/1913 | Hollett |
| 1,772,625 | A | 8/1930 | Caulfield |
| 2,192,722 | A | 3/1940 | Vogt |

(Continued)

FOREIGN PATENT DOCUMENTS

| | | |
|---|---|---|
| DE | 28 06 308 A1 | 8/1978 |
| DE | 29 23 455 | 12/1980 |

(Continued)

OTHER PUBLICATIONS

International Search Report and Written Opinion for PCT/US2017/016159 dated May 12, 2017.

(Continued)

*Primary Examiner* — Brian D Nash
(74) *Attorney, Agent, or Firm* — Womble Bond Dickinson (US) LLP

(57) ABSTRACT

A carton for holding at least one article is disclosed herein. The carton includes panels that extend at least partially around the interior of the carton including a front panel, a first side panel, a second side panel, and a back panel. A reclosable top has a first top panel foldably connected to the front panel, a second top panel foldably connected to the back panel, a first gusset foldably connected to the first side panel, and a second gusset foldably connected to the second side panel. The reclosable top is positionable between a closed position and an open position. The first gusset and the second gusset have closure features biasing the first top panel and the second top panel to the closed position.

32 Claims, 19 Drawing Sheets

(56) References Cited

U.S. PATENT DOCUMENTS 2,355,665 A 8/1944 Mabee
2,475,677 A 7/1949 Ringler
2,509,289 A 5/1950 Dunning
2,757,851 A 8/1956 Moore
3,133,688 A 5/1964 Asman
3,300,115 A 1/1967 Schauer
3,355,089 A 11/1967 Champlin
3,363,822 A 1/1968 Maulini et al.
3,426,955 A 2/1969 Olson
3,529,763 A 9/1970 Wagner
3,581,977 A 6/1971 Kirsky et al.
3,669,345 A 6/1972 Cote
3,680,766 A 8/1972 Collura et al.
3,690,544 A 9/1972 Meyers
3,768,719 A 10/1973 Johnson
3,971,503 A * 7/1976 Allan ..... B65D 5/08 294/1.3
4,252,267 A 2/1981 Osborne
4,272,009 A * 6/1981 Bamburg ..... B65D 5/0005 229/101
4,313,553 A 2/1982 Lisiecki
4,344,537 A 8/1982 Austin
4,508,218 A 4/1985 Focke et al.
4,558,785 A 12/1985 Gordon
4,645,108 A 2/1987 Gavin et al.
4,676,394 A 6/1987 Hiersteiner
4,712,727 A * 12/1987 Wyberg ..... B65D 5/067 229/137
4,762,234 A 8/1988 Wyberg
4,848,589 A * 7/1989 Olson ..... B65D 5/068 229/249
4,905,898 A 3/1990 Wade
5,020,337 A * 6/1991 Krieg ..... F25D 3/06 229/103
5,255,494 A 10/1993 Doyle
5,292,058 A 3/1994 Zoss et al.
5,326,024 A 7/1994 Fogle
5,347,865 A 9/1994 Mulry et al.
5,501,394 A 3/1996 Eno
5,632,402 A 5/1997 Walsh et al.
5,632,404 A 5/1997 Walsh
5,746,871 A 5/1998 Walsh
5,783,030 A 7/1998 Walsh
5,794,811 A 8/1998 Walsh
5,794,812 A 8/1998 Walsh
5,816,487 A 10/1998 Skinner
5,857,614 A 1/1999 Walsh
5,918,799 A 7/1999 Walsh
5,988,494 A 11/1999 Fontaine
5,996,882 A 12/1999 Randall
6,050,484 A 4/2000 Galomb
6,062,467 A 5/2000 Ours et al.
6,102,277 A 8/2000 Krapohl, Sr.
6,145,736 A 11/2000 Ours et al.
6,164,821 A 12/2000 Randall
6,206,279 B1 3/2001 Countee
6,352,096 B1 3/2002 Walsh
6,364,202 B1 4/2002 Zelley
6,419,151 B1 7/2002 Urtubey
6,854,639 B2 2/2005 Walsh
6,913,189 B2 * 7/2005 Oliff ..... B65D 5/5495 229/120.011
6,929,172 B2 8/2005 Bates et al.
7,025,504 B2 4/2006 Olin
7,036,714 B2 5/2006 Walsh et al.
7,210,612 B2 5/2007 Walsh et al.
7,331,509 B2 2/2008 Bates et al.
7,611,042 B2 * 11/2009 Bates ..... B65D 5/0005 206/427
7,617,969 B2 11/2009 Oliveira
7,913,897 B2 3/2011 Manaige
8,672,214 B2 3/2014 Manaige
8,770,469 B2 7/2014 Burke et al.
9,169,037 B2 * 10/2015 Pinkstone ..... B65D 5/10
9,346,582 B2 5/2016 Pinkstone
10,023,350 B2 * 7/2018 Faulkner ..... B65D 5/541
2001/0048022 A1 12/2001 Zoeckler
2002/0055429 A1 5/2002 Walsh
2003/0144121 A1 7/2003 Walsh et al.
2004/0102748 A1 5/2004 Hirotsu
2004/0112948 A1 6/2004 Bone
2004/0226989 A1 11/2004 Cook et al.
2005/0127150 A1 6/2005 Walsh et al.
2005/0187087 A1 8/2005 Walsh
2005/0199695 A1 9/2005 DeBusk et al.
2005/0209576 A1 9/2005 Hirotsu
2005/0274782 A1 12/2005 Petrelli et al.
2006/0054675 A1 3/2006 Bennett
2006/0243783 A1 11/2006 Spivey, Sr. et al.
2006/0255107 A1 11/2006 Wright
2007/0194093 A1 8/2007 Ford
2008/0296360 A1 12/2008 Abel et al.
2015/0368019 A1 12/2015 Pinkstone
2017/0113832 A1 4/2017 Faulkner

FOREIGN PATENT DOCUMENTS

DE 81 10 323.9 9/1981
DE 87 08 078.8 10/1987
DE 94 13 813 10/1994
EP 1 457 425 9/2004
FR 2 699 150 6/1994
FR 2 755 670 5/1998
GB 104445 3/1917
GB 1 242 356 8/1971
GB 1 489 963 10/1977
GB 1 584 066 2/1981
GB 2 363 372 12/2001
KR 20-1998-0019535 7/1998
KR 10-0211329 8/1999
KR 10-0354924 10/2002
KR 10-2004-0004669 1/2004
KR 10-2005-0013599 2/2005
WO WO 95/28325 10/1995
WO WO 2006/124643 11/2006
WO WO 2006/133401 12/2006
WO WO 2007/050722 A1 5/2007

OTHER PUBLICATIONS

Supplementary European Search Report for EP 17 74 8125 dated Jun. 14, 2019.

* cited by examiner

CARTON WITH RECLOSABLE TOP

CROSS-REFERENCE TO RELATED APPLICATIONS

This application claims the benefit of U.S. Provisional Patent Application No. 62/291,708 filed Feb. 5, 2016.

INCORPORATION BY REFERENCE

The disclosure of U.S. Provisional Patent Application No. 61/291,708, which was filed Feb. 5, 2016, is hereby incorporated by references for all purposes as if presented herein in its entirety.

BACKGROUND OF THE DISCLOSURE

The present disclosure relates to packages or cartons for holding and carrying articles and related blanks and methods, and such cartons having a reclosable top.

SUMMARY OF THE DISCLOSURE

In general, one aspect of the present disclosure is generally directed to a carton for holding at least one article. The carton includes panels that extend at least partially around the interior of the carton. The panels include a front panel, a first side panel, a second side panel, and a back panel. The carton includes a reclosable top having a first top flap foldably connected to the front panel, a second top flap foldably connected to the back panel, a first top gusset foldably connected to the first side panel and a second top gusset foldably connected to the second side panel. The reclosable top is positionable between a closed position closing the interior and an open position allowing access to the interior. The reclosable top is positionable from the open to the closed position by downwardly folding at least one of the first top flap or the second top flap. The reclosable top has engagement features for allowing the top to remain in the closed position.

In another aspect, this disclosure is generally directed to a carton for holding at least one article. The carton comprising a plurality of panels extending at least partially around an interior of the carton. The plurality of panels comprising a front panel, a first side panel, a second side panel, and a back panel. A reclosable top comprises a first top panel foldably connected to the front panel, a second top panel foldably connected to the back panel, a first gusset foldably connected to the first side panel, and a second gusset foldably connected to the second side panel. Each of the first gusset and the second gusset are respectively foldably connected to the first top panel and the second top panel. The reclosable top is positionable between a closed position wherein the first top panel and the second top panel are downwardly folded to at least partially close the interior of the carton and an open position wherein the first top panel and the second top panel allow access to the interior of the carton. The first gusset and the second gusset have closure features biasing the first top panel and the second top panel to the closed position.

In another aspect, this disclosure is generally directed to a blank for forming a carton for holding at least one article. The blank comprising a plurality of panels comprising a front panel, a first side panel, a second side panel, and a back panel. The plurality of panels being for forming an interior of the carton formed from the blank. The blank comprises reclosable features for forming a reclosable top of the carton formed from the blank. The reclosable features comprise a first top panel foldably connected to the front panel, a second top panel foldably connected to the back panel, a first gusset foldably connected to the first side panel, and a second gusset foldably connected to the second side panel. Each of the first gusset and the second gusset are respectively foldably connected to the first top panel and the second top panel. The reclosable top is positionable between a closed position wherein the first top panel and the second top panel are downwardly folded to at least partially close the interior of the carton formed from the blank and an open position wherein the first top panel and the second top panel are positioned allow access to the interior of the carton formed from the blank. The first gusset and the second gusset have closure features biasing the first top panel and the second top panel to the closed position in the carton formed from the blank.

In another aspect, this disclosure is generally directed to a method of forming a carton for holding at least one article. The method comprising obtaining a blank comprising a plurality of panels. The plurality of panels comprises a front panel, a first side panel, a second side panel, and a back panel. The blank comprises reclosable features for forming a reclosable top. The reclosable features comprising a first top panel foldably connected to the front panel, a second top panel foldably connected to the back panel, a first gusset foldably connected to the first side panel, and a second gusset foldably connected to the second side panel. Each of the first gusset and the second gusset are respectively foldably connected to the first top panel and the second top panel. The method comprises positioning the plurality of panels to form an interior of the carton and positioning the reclosable features to form the reclosable top. The reclosable top is positionable between a closed position wherein the first top panel and the second top panel are downwardly folded to at least partially close the interior of the carton and an open position wherein the first top panel and the second top panel allow access to the interior of the carton. The first gusset and the second gusset have closure features biasing the first top panel and the second top panel to the closed position of the reclosable top.

Those skilled in the art will appreciate the above stated advantages and other advantages and benefits of various additional embodiments reading the following detailed description of the embodiments with reference to the below-listed drawing figures.

BRIEF DESCRIPTION OF THE DRAWINGS

According to common practice, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION OF THE EXEMPLARY EMBODIMENTS

Cartons or packages according to the present disclosure can accommodate articles of numerous different shapes. For the purpose of illustration and not for the purpose of limiting the scope of the disclosure, the following detailed description describes articles such as food products at least partially disposed within the carton embodiments. In this specification, the terms "lower," "bottom," "upper," "top," "front," and "back" indicate orientations determined in relation to fully erected cartons.

Figure 1:
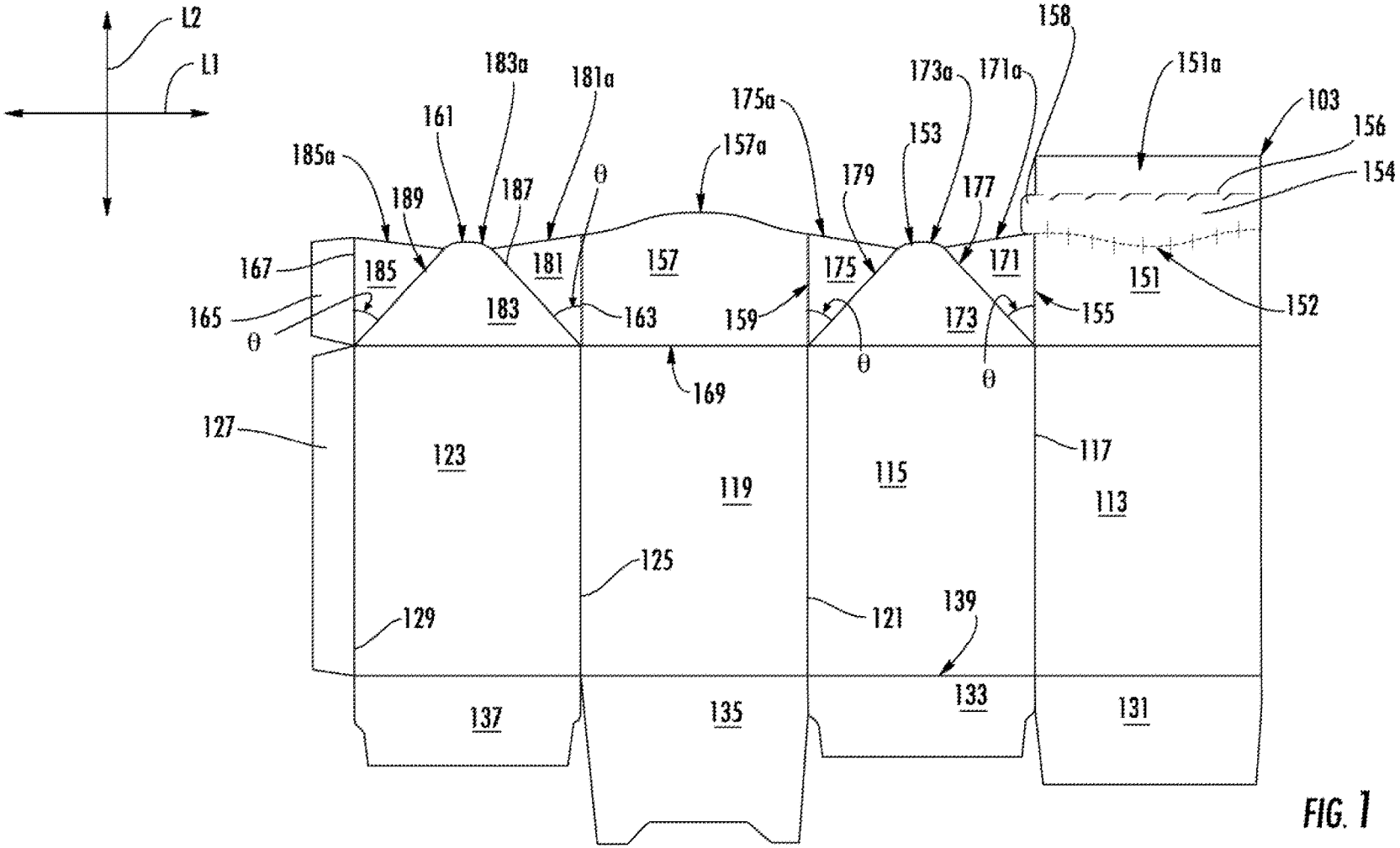
FIG. 1 is a plan view of an exterior surface of a blank for forming a carton according to a first embodiment of this disclosure.
Figure 2A:
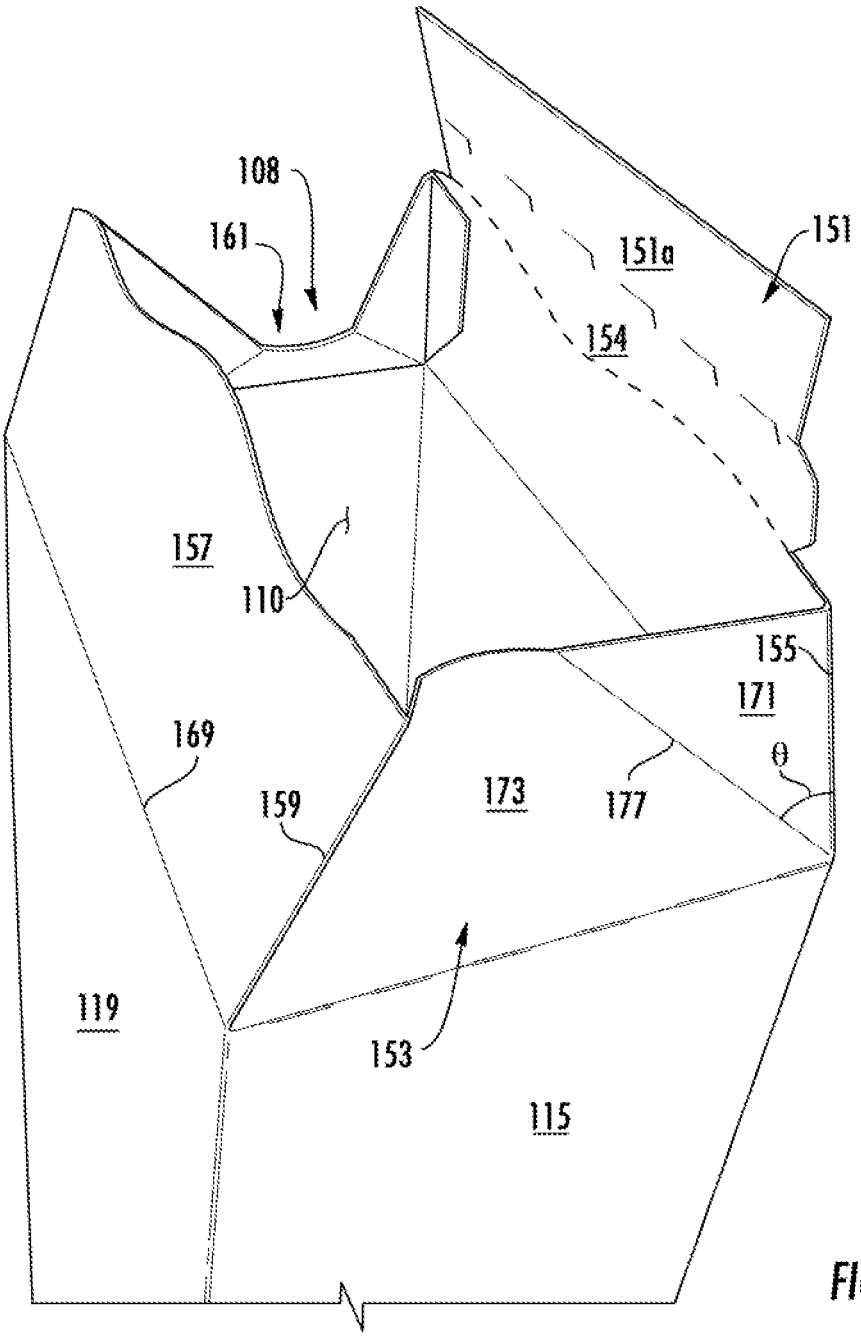
FIG. 2A is a perspective view of the top of the carton of FIG. 1 in an open position.
Figure 2B:
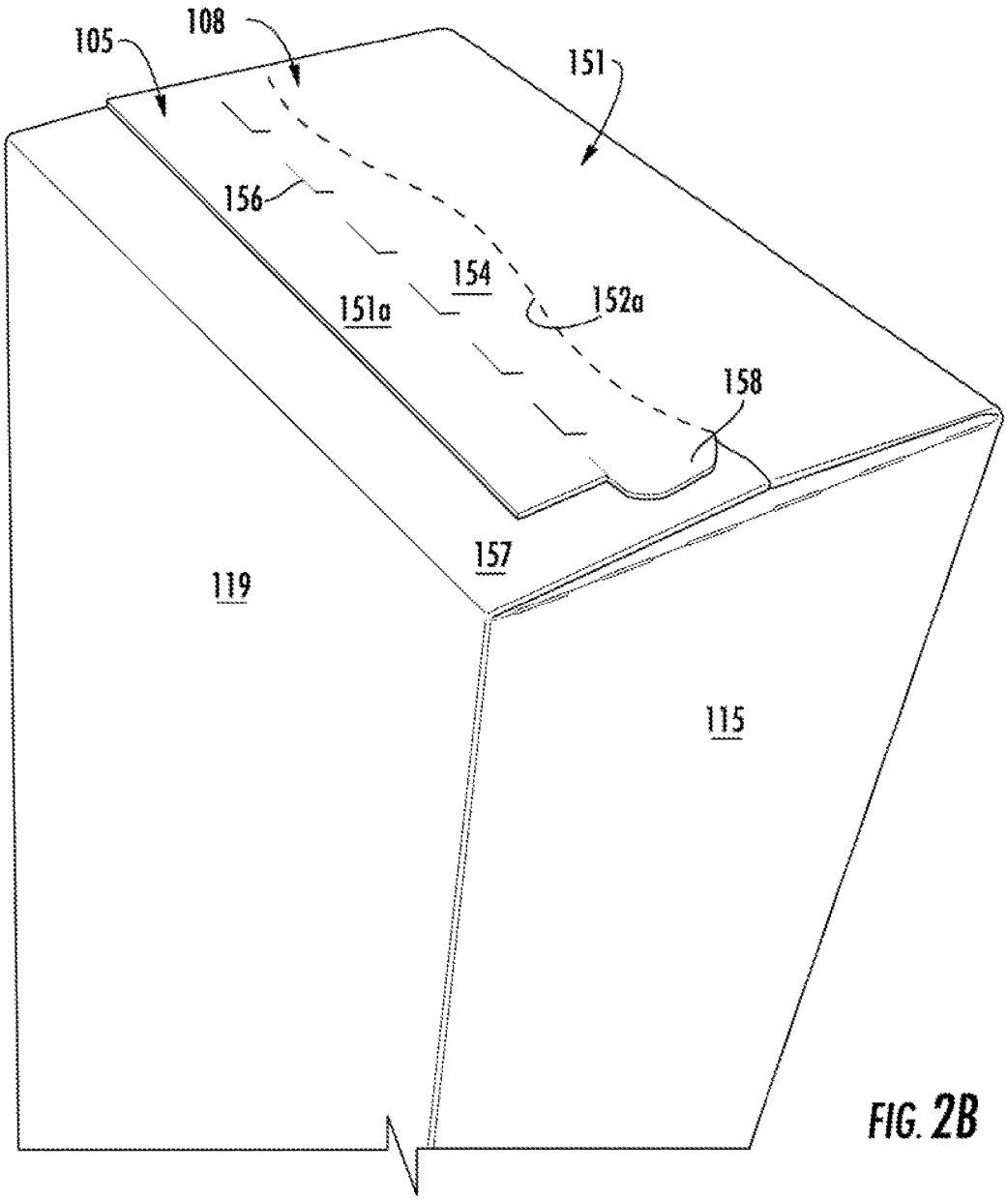
FIG. 2B is a perspective view of the top of the carton of FIG. 1 in a closed position.
Figure 2C:
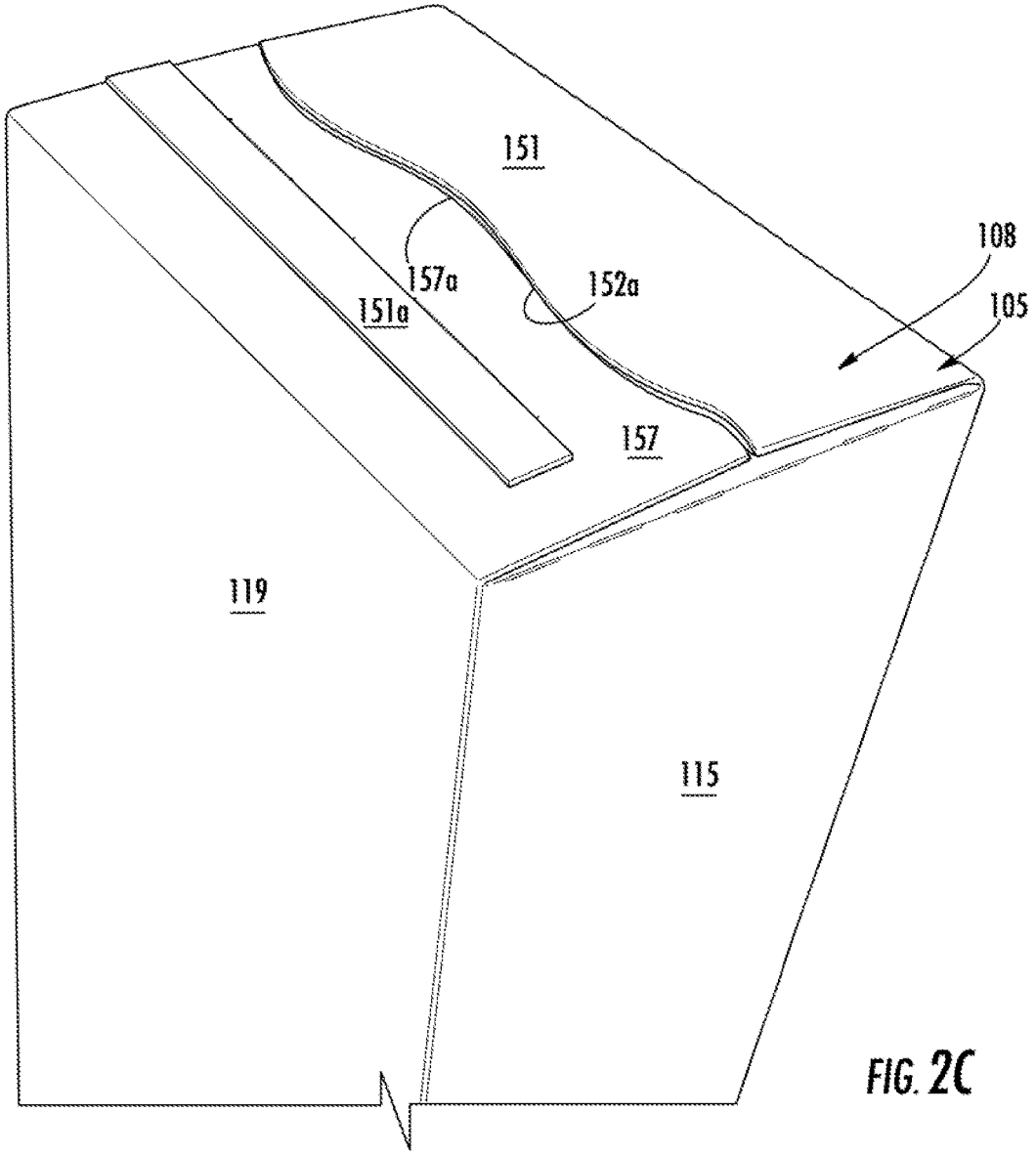
FIG. 2C is a perspective view of the top of the carton of FIG. 1 with the tear strip separated.
Figure 2D:
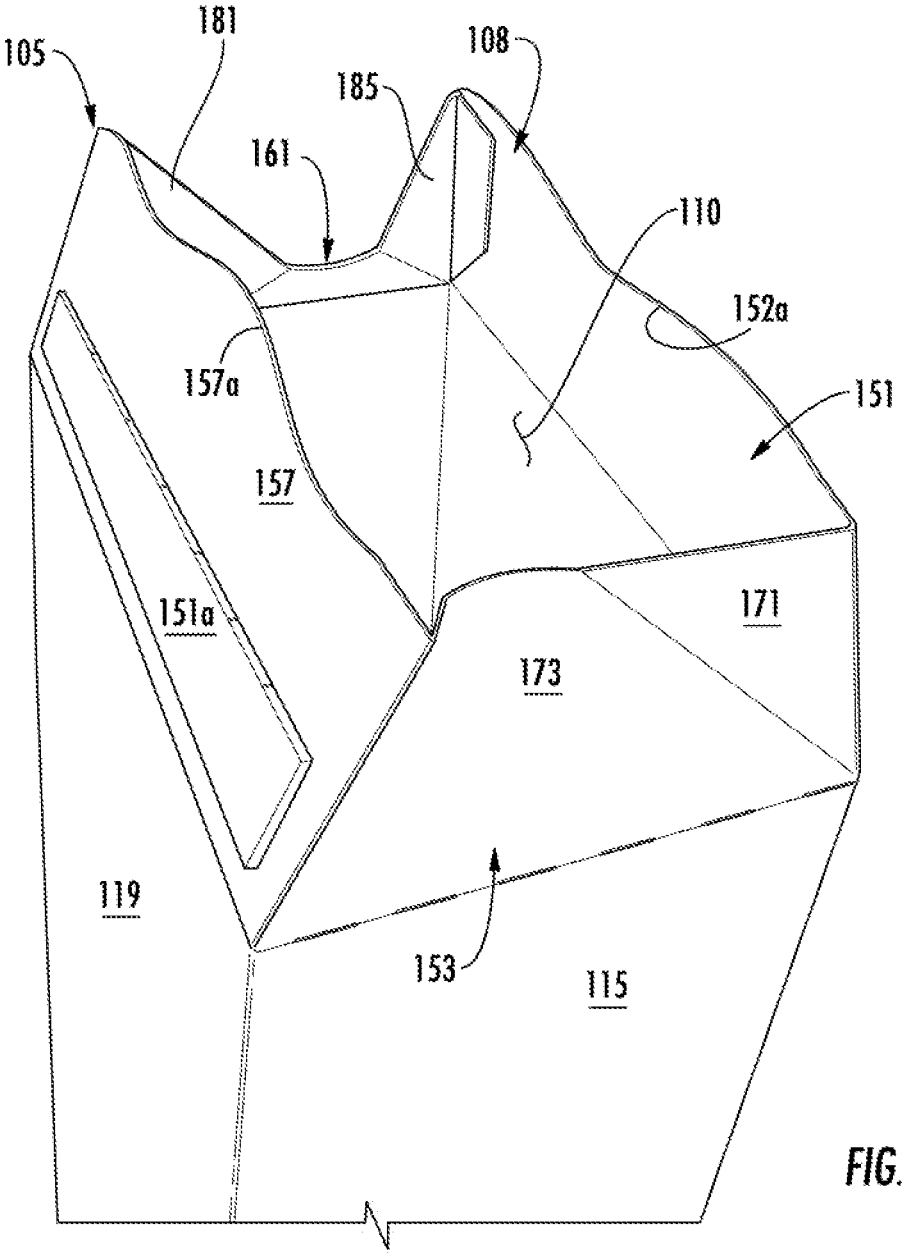
FIG. 2D is a perspective view of the top of the carton of FIG. 1 in an open position with the tear strip separated.
Figure 2E:
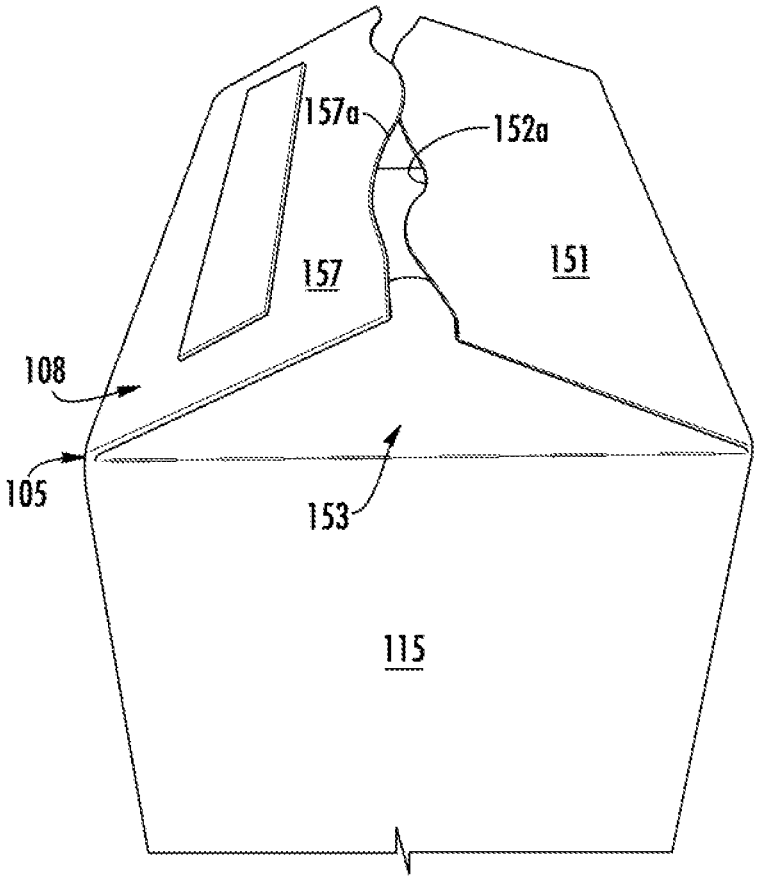
FIG. 2E is a perspective view of the top of the carton of FIG. 1 being reclosed after the tear strip has been separated.
Figure 2F:
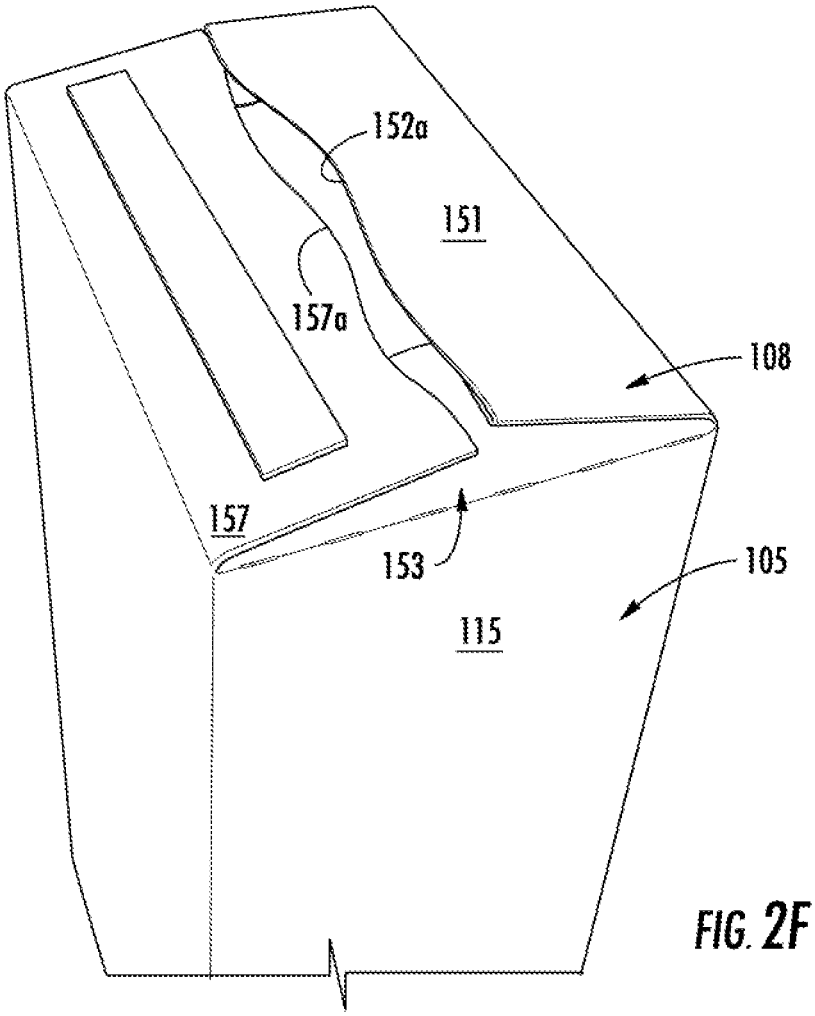
FIG. 2F is a perspective view of the top of the carton of FIG. 1 being reclosed after the tear strip has been separated.
Figure 2G:
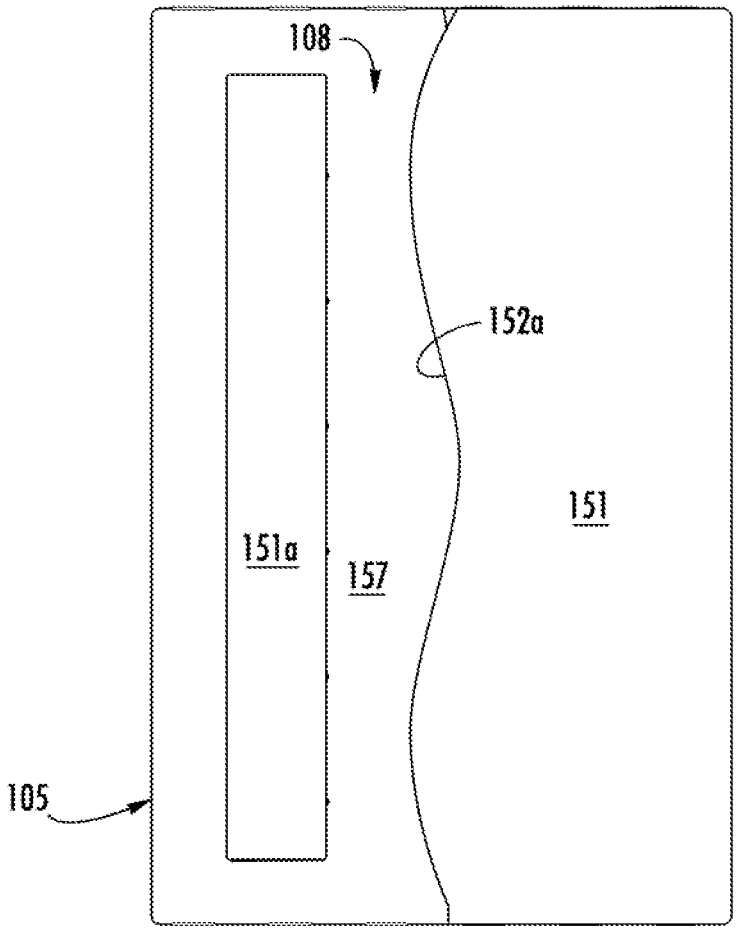
FIG. 2G is a perspective view of the top of the carton of FIG. 1 in a closed position after the tear strip has been separated.
Figure 3:
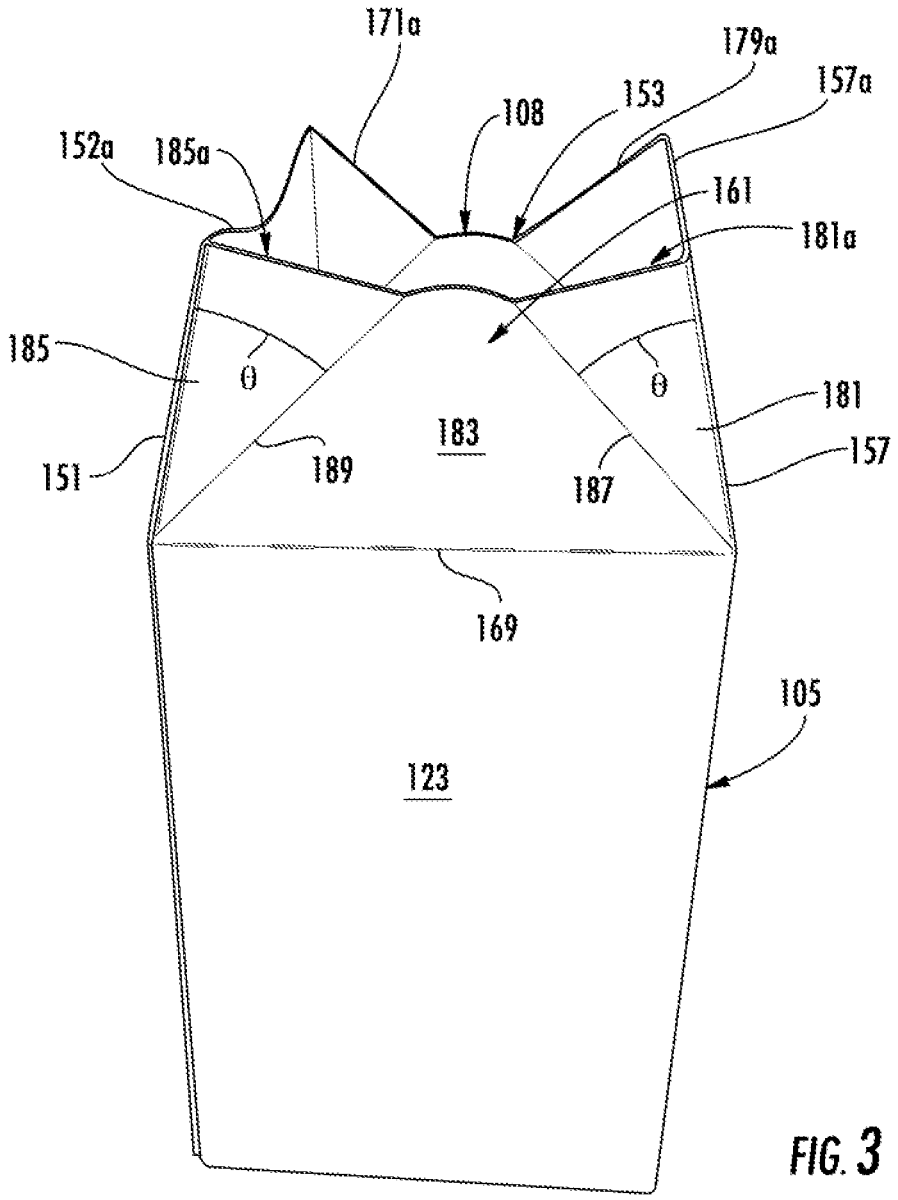
FIG. 3 is a perspective view of the carton of FIG. 1 in an open position after the tear strip has been separated.

FIG. 1 is a plan view of an exterior surface 1 of a carton blank 103 used to form a carton 105 (FIG. 2) according to one embodiment of this disclosure. The carton 105 can be used to hold one article or a plurality of articles (not shown) such as food products (e.g., cookies, power bars, granola bars, cereal, or any other food product), beverage products, or other liquid or dry products such as laundry detergent or cosmetics, or any other article or product. The carton 105 has a reclosable top 108 that is positionable between a closed position (FIGS. 2B, 2C, and 2G) and an open position (FIGS. 2D and 3). The reclosable top 108 has closure features to allow the reclosable top to be closed in a simple and efficient manner and engagement features that allow the top to remain closed until opened. The carton 105 can also include various dispensing features and other or additional closing features without departing from the disclosure.

The blank 103 has a longitudinal axis L1 and a lateral axis L2. The blank 103 includes a front panel 113 foldably connected to a first side panel 115 at a lateral fold line 117. A back panel 119 is foldably connected to the first side panel 115 at a lateral fold line 121. A second side panel 123 is foldably connected to the back panel 119 at a lateral fold line 125. An adhesive flap 127 is foldably connected to the second side panel 123 at a lateral fold line 129.

As shown in FIG. 1, bottom end flaps 131, 133, 135, 137 are respectively foldably connected to a respective one of the front panel 113, first side panel 115, back panel 119, and second side panel 123. The bottom end flaps 131, 133, 135, 137 are foldably connected to respective panels 113, 115, 119, 123 at a marginal portion of the blank 103 by a longitudinal fold line 139. The fold line 139 can be otherwise shaped or can be offset at portions of the blank 103 without departing from the disclosure. The bottom end flaps 131, 133, 135, 137 could be otherwise shaped, arranged, and/or configured without departing from the disclosure.

In the illustrated embodiment, the blank 103 includes a first top panel 151 foldably connected to a first gusset 153 at a lateral fold line 155. A second top panel 157 is foldably connected to the first gusset 153 at a lateral fold line 159. A second gusset 161 is foldably connected to the second top panel 157 at a lateral fold line 163. An adhesive flap 165 is foldably connected to the second gusset 161 at a lateral fold line 167. The panels and gussets 151, 153, 157, 161 are foldably connected to respective panels 113, 115, 119, 123 at a marginal portion of the blank 103 by a longitudinal fold line 169.

In one embodiment, the first gusset 153 comprises a first gusset panel 171, a second gusset panel 173, and a third gusset panel 175 that are generally triangular-shaped panels. The first gusset panel 171 is foldably connected to the second gusset panel 173 along a first oblique fold line 177, and the third gusset panel 175 is foldably connected to the second gusset panel 173 along a second oblique fold line 179. The first gusset panel 171 has a free edge 171*a*, and the third gusset panel 175 has a free edge 175*a*. In the illustrated embodiment, the free edges 171*a*, 175*a* extend obliquely from a respective lateral fold line 155, 159. In one embodiment, the second gusset panel 173 has a curved free edge 173*a* generally extending between the opposite edges 171*a*, 175*a* of the gusset panels 171 and 175. In one embodiment, the free edge 173*a* is generally convexly curved with respect to the first side panel 115. The first gusset 153 could be otherwise shaped, arranged, and/or configured without departing from the disclosure.

In one embodiment, the second gusset 161 is shaped generally similar to the first gusset 153 and comprises a fourth gusset panel 181, a fifth gusset panel 183, and a sixth gusset panel 185 that are generally triangular-shaped panels. The fourth gusset panel 181 is foldably connected to the fifth gusset panel 183 along a third oblique fold line 187, and the sixth gusset panel 185 is foldably connected to the fifth gusset panel 183 along a fourth oblique fold line 189. The fourth gusset panel 181 has a free edge 181*a*, and the sixth gusset panel 185 has a free edge 185*a*. In the illustrated embodiment, the free edges 181*a*, 185*a* extend obliquely from a respective lateral fold line 163, 167. In one embodiment, the fifth gusset panel 183 has curved free edge 183*a* generally extending between the opposite edges 181*a*, 185*a* of the gusset panels 181 and 185. In one embodiment, the free edge 183*a* is generally convexly curved with respect to the second side panel 123. The gussets 153, 161 could be otherwise shaped, arranged, and/or configured without departing from the disclosure.

As shown in FIG. 1, the first gusset 153 and second gusset 161 has closure features that include the arrangement and positioning of the first oblique fold line 177, the second oblique fold line 179, the third oblique fold line 187, and the fourth oblique fold line 189. Each of the oblique fold lines 177, 179, 187, 189 intersects a respective lateral fold line 155, 159, 163, 167 at an angle θ. The angle θ may be less than 45 degrees. In some embodiment, the angle θ can be in the range of approximately 40 degrees to approximately 43 degrees. In the illustrated embodiment, the angle θ is approximately 42 degrees. In other embodiments, angle θ may be less than 40 degrees or greater than 45 degrees without departing from the scope of the disclosure.

As illustrated in FIG. 1, the first top panel 151 includes an attachment portion 151*a* at a distal portion of the first top panel and a tear strip 154 defined by a first tear line 152 and a second tear line 156 that connects the attachment portion 151 to the tear strip. The tear strip 154 may comprise a tab 158 extending outwardly from the top panel 151 adjacent the top edge 171*a* of the first gusset panel 171. In one embodiment, the tear line 152 is generally curved and is concave extending between the edges of the top panel 151. The tear line 152 may be alternatively shaped or arranged without departing from the disclosure. As shown in FIG. 1, the tear line 156 is generally longitudinal extending across the first top panel 151. The second top panel 157 includes a free edge 157*a* that is generally curved and is convex or has a convex central portion. The top panels 151, 157 and gussets 153, 161 can be otherwise shaped, arranged, and/or configured without departing from the scope of the disclosure.

The blank 103 can by formed into the carton 105 and loaded with articles by a suitable packaging system (not shown). The packaging system can comprise different stations, modules, or components, such as a carton forming station, a wrapping station, a pick and place station, a closing or sealing station, or any other suitable station or components. The blank 103 can be formed into the carton 105 by other packaging systems without departing from the disclosure.

In accordance with one acceptable example, the carton 105 is formed from the blank 103, by folding the panels 113, 115, 119, 123 along fold lines 117, 121, 125 and adhesively attaching the adhesive flap 127, that is folded about fold line 129, to front panel 113 and also adhesively attaching the attachment flap 165 to the first top panel 151. In this way, the first top panel 151 is foldably connected to the second gusset 161 and the second side panel 123 is foldably connected to the front panel 113 to form an interior space 110 of the carton 105. Prior to closing the reclosable top 108, the first top panel 151, second top panel 157, first gusset 153, and second gusset 161 extend from a respective one of the panels 113, 115, 119, 123 to form and open top and the bottom end flaps 131, 133, 135, 137 extend from a respective one of the panels 113, 115, 119, 123 to from an open bottom. The bottom of the carton 105 can be closed by respectively folding and at least partially overlapping the bottom end flaps 131, 133, 135, 137. One or more of the bottom end flaps 131, 133, 135, 137 can be adhesively secured such as by glue without departing from the disclosure. At this stage as shown in FIG. 2A, the interior space 110 of the carton 105 is formed by the panels 113, 115, 119, 123, and the carton has a closed bottom formed by the bottom end flaps 131, 133, 135, 137, and the reclosable top 108 is in the open configuration allowing access to the interior space 110. The carton 105 can be filled by placing an article or a plurality of articles in the interior space 110 after closing the bottom end flaps 131, 133, 135, 137 or prior to closing the bottom without departing from the disclosure.

The reclosable top 108 of the carton 105 can positioned to the closed position by activating the gussets 153, 161 to position the central gusset panels (i.e., second gusset panel and fifth gusset panel) 173, 183 of each gusset inwardly relative to a respective side panel 115, 123, so that the gusset panels 173, 183 fold downward. The secondary gusset panels (i.e., the third gusset panel and fourth gusset panel) 175, 181 are overlapped by and positioned in face-to-face contact with a portion of the second top panel 157 when the gusset panels 173, 183 are downwardly folded to position the reclosable top 108 is positioned to the closed position. Similarly, the secondary gusset panels (i.e., the first gusset panel and the sixth gusset panel) 171, 185 are overlapped by and positioned in face-to-face contact with a portion of the first top panel 151 when the gusset panels 173, 183 are downwardly folded to position the reclosable top 108 in the closed position. When the gussets 153, 161 are activated to initially close the reclosable top 108 of the carton 105, the first top panel 151 overlaps the second top panel 157 and the first and second top panels 151, 157 are positioned in face-to-face contact to close the top of the carton. In one embodiment, the initial downward folding of the central gusset panels 173, 183 causes the downward folding of the first and second top panels 151, 157 that overlap the respective gusset panels 171, 175, 181, 185. The gusset panels 171, 175 overlap and are in face-to-face contact with a portion of the central gusset panel 173 when the reclosable top 108 is closed and the gusset panels 181, 185 are in face-to-face contact with a portion of the central gusset panel 183 when the reclosable top 108 is closed. When the reclosable top 108 is initially closed, the adhesive portion 151*a* and the tear strip 154 overlap and are in face-to-face contact with a portion of the second top panel 157 (FIG. 2B). In the initial closed configuration of the reclosable top 108 of the carton 105 (FIG. 2B), the attachment portion 151*a* is adhesively secured to the exterior surface of the second top panel 157, and the tear strip 154 is free from adhesive attachment to the second top panel 157.

The carton 105 can be initially opened by pulling the tab 158 and separating the tear strip 154 from the carton 105 (FIG. 2C) by tearing along tear lines 152, 156. Removal of the tear strip 154 forms an edge 152*a* of the first top panel 151 corresponding to the location of the tear line 152. Pressure can be applied to panels 115, 123 with a user's hand to push the panels 115, 123 slightly forward causing the reclosable top 108 of the carton 105 to open. Alternatively, the edge 152*a* of the first top panel 151 or the edge 157*a* of the second top panel 157 can be grasped to pull the first top panel 151 or second top panel 157 upwardly to position the reclosable top 108 of the carton 105 to the open position (FIG. 2D). Articles such as food products (not shown) may be removed from the carton 105. As illustrated in FIGS. 2E-2G, the reclosable top 108 of the carton 105 can be reclosed and held in the closed position by pushing the second top panel 157 downwardly, causing the gussets 153 and 161 and the opposite top end panel 151 to inwardly fold. Alternatively, the top 108 of the carton can be reclosed by pushing the first top panel 151 downwardly in a similar manner without departing for the disclosure. In one embodiment, the reclosable top 108 of the carton 105 including the gusset panels 153, 161 and panels 151, 157 is configured to simplify the closing process. As the top panels 151, 157 are pushed downwardly, the closure features of the reclosable top including the gussets 153, 161 are configured to bias the reclosable top 108 to the closed position. The gussets 151, 153 are configured in this manner by selecting the angle θ of the oblique fold lines 177, 179, 187, 189 of the gussets 153, 161 to create a biasing force when the gussets 153, 161 are downwardly folded. The biasing force of the gussets 153, 161 allows for the reclosable top 108 to fully close while only providing a force to one or both of the first top panel 151 and second top panel 157 that causes the top panels to only partially fold downward. The biasing force created by the configuration of the gussets 151, 153 with the oblique fold lines 177, 179, 187, 189 positioned at an angle θ relative to the lateral fold lines 155, 159, 163, 167 will force the top panels the remaining distance downward to fully close the reclosable top 108 so that the user is given the sensation of an easy closing reclosable top 108 that does not require the user to provide the force to position the first top panel 151 and second top panel 157 to a position perpendicular to the panels 113, 115, 119, 123.

Figure 4:
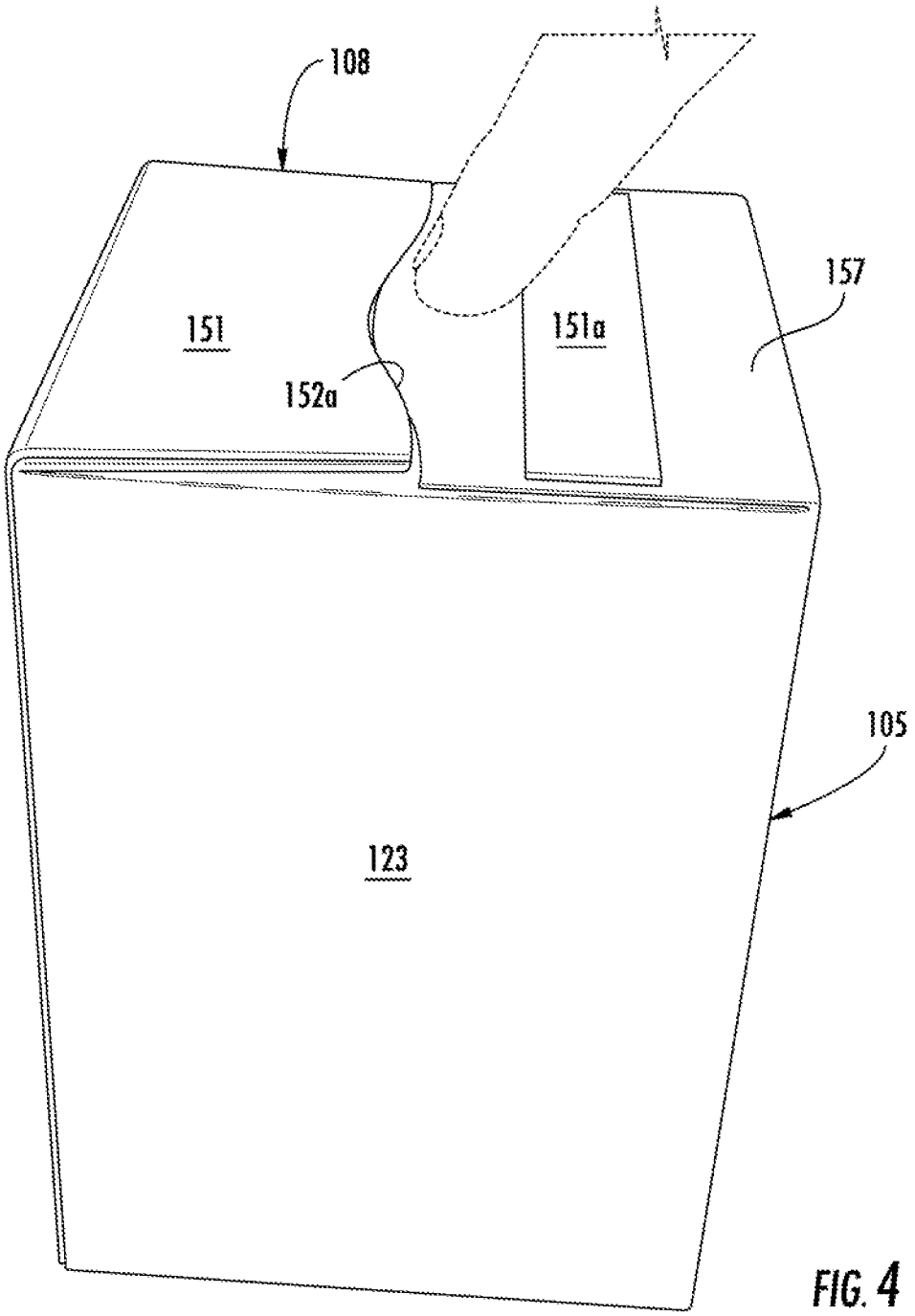
FIG. 4 is a perspective view of the carton of FIG. 1 in a closed position after the tear strip has been separated.

The reclosable top 108 of the carton 105 can be positioned between the open configuration (FIGS. 2D and 3) and the closed configuration (FIGS. 2C, 2G, and 4) by alternative steps or methods without departing from the disclosure. Also, the carton 105 can be formed by other steps and methods without departing from the disclosure.

Figure 5:
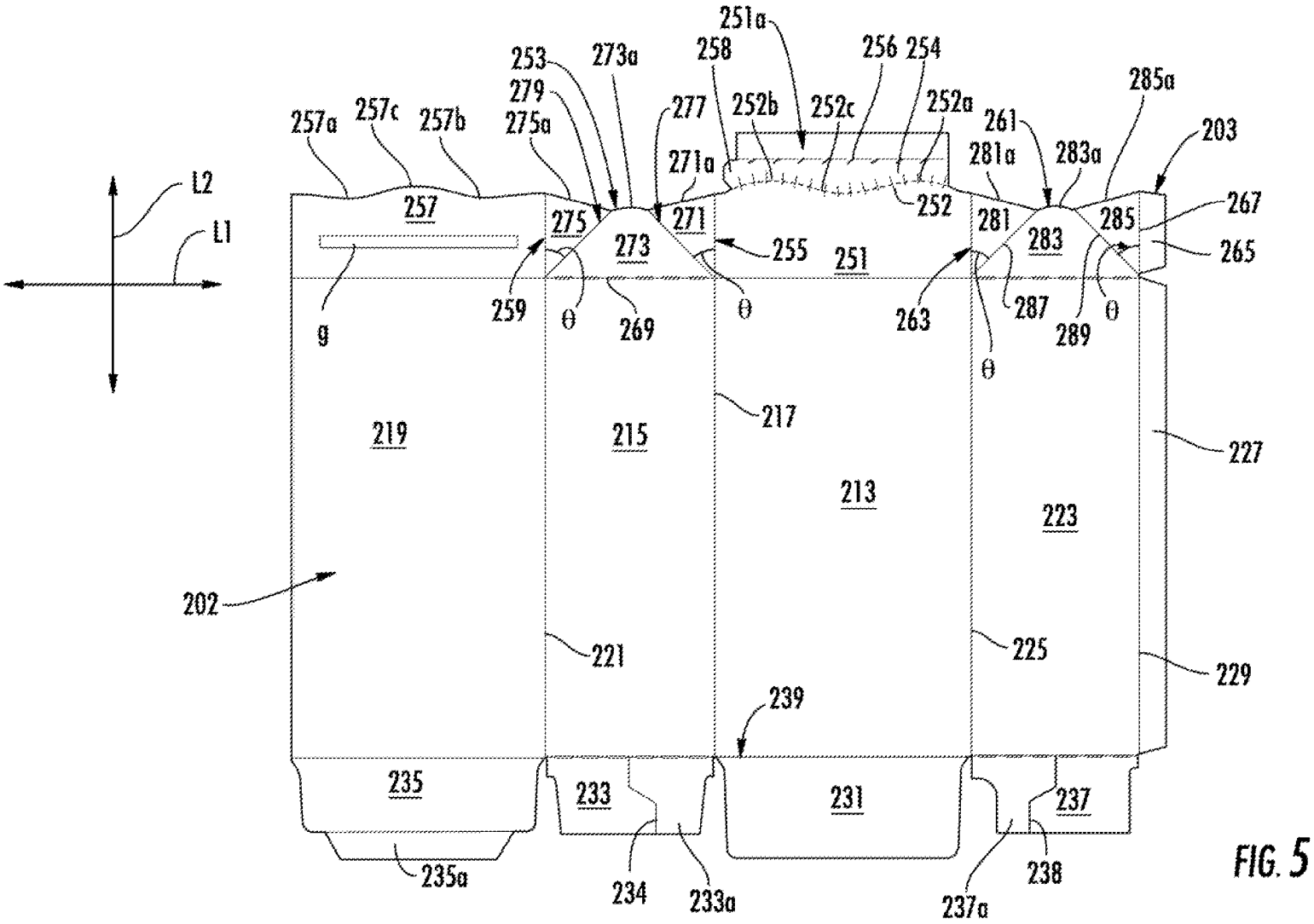
FIG. 5 is a plan view of an exterior surface of a blank for forming a carton according to a second embodiment of this disclosure.
Figure 6:
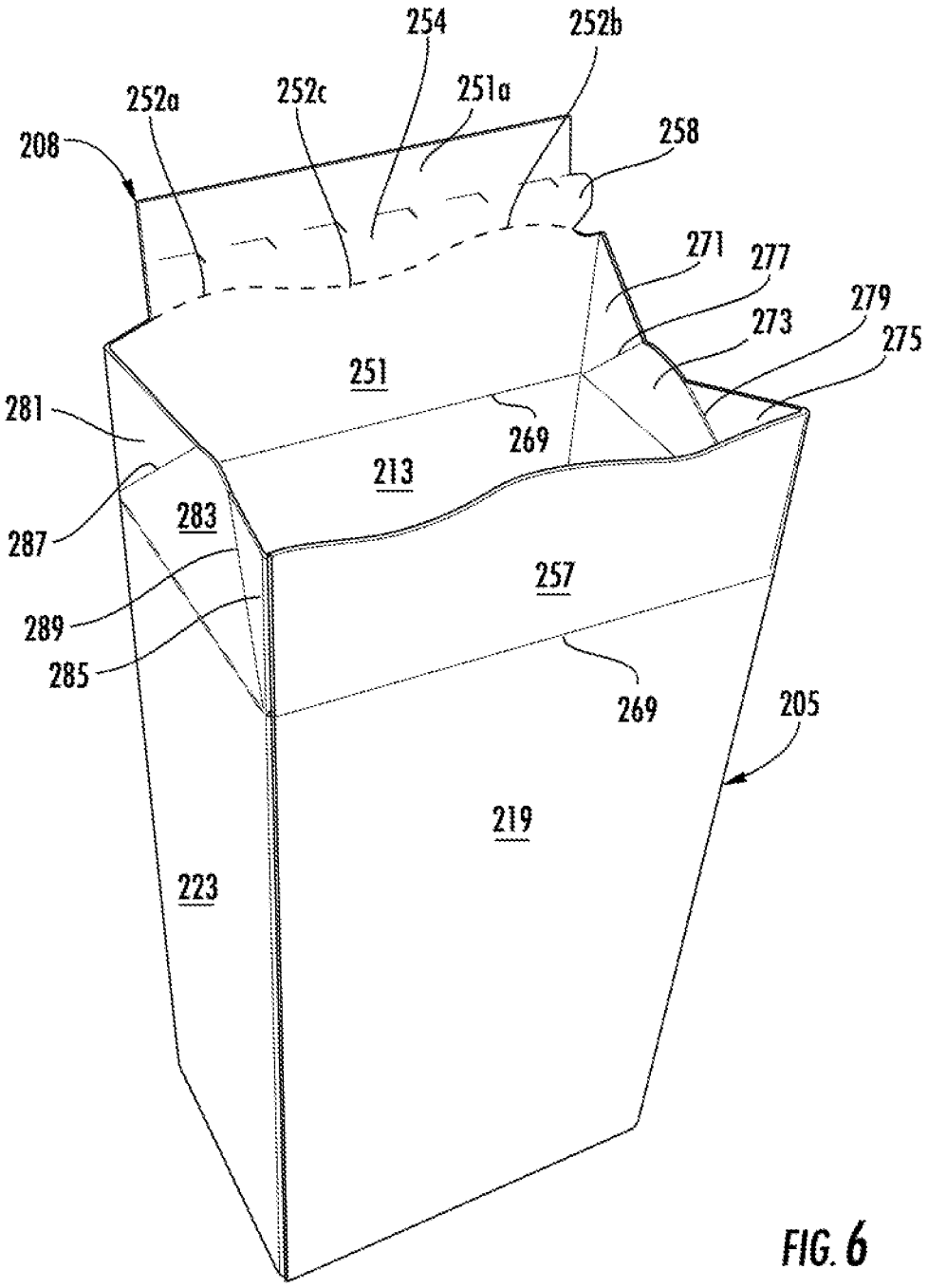
FIG. 6 is a perspective view of the carton of FIG. 5 in an open position.

FIG. 5 illustrates an exterior surface 202 of a blank 203 for forming a carton 205 (FIGS. 6-10) according to a second embodiment of the disclosure. The second embodiment is generally similar to the first embodiment, except for variations noted and variations that will be apparent to one of ordinary skill in the art. Accordingly, similar or identical features of the embodiments have been given like or similar reference numbers. As shown in FIG. 5, the blank 203 has a longitudinal axis L1 and a lateral axis L2. The blank 203 includes a front panel 213 foldably connected to a first side panel 215 at a lateral fold line 217 and a second side panel 223 at a lateral fold line 225. A back panel 219 is foldably connected to the first side panel 215 at a lateral fold line 221. An adhesive flap 227 is foldably connected to the second side panel 223 at a lateral fold line 229.

As shown in FIG. 5, bottom end flaps 231, 233, 235, 237 are respectively foldably connected to a respective one of the front panel 213, first side panel 215, back panel 219, and second side panel 223. The bottom end flaps 231, 233, 235, 237 are foldably connected to respective panels 213, 215, 219, 223 at a marginal portion of the blank 203 by a longitudinal fold line 239. According to some embodiments, the bottom panels 233, 237 have deboss or emboss portions 233*a*, 237*a* defined by lines of weakening 234, 238. According to some embodiments, an attachment flap 235*a* may be foldably connected to the bottom end flap 235. The fold line 239 can be otherwise shaped or be offset at portions of the blank 203 without departing from the disclosure.

In the illustrated embodiment, the blank 203 includes a first top panel 251 foldably connected to a first gusset 253 at a lateral fold line 255 and a second gusset 261 is foldably connected to the first top panel 251 at a lateral fold line 263. A second top panel 257 is foldably connected to the first gusset 253 at a lateral fold line 259. An adhesive flap 265 is foldably connected to the second gusset 261 at a lateral fold line 267. The flaps and gussets 251, 253, 257, 261 are foldably connected to respective panels 213, 215, 219, 223 at a marginal portion of the blank 203 by a longitudinal fold line 269. In one embodiment, the longitudinal fold line 269 includes perforations as illustrated in FIG. 5.

In one embodiment, the first gusset 253 has three generally triangular gusset panels 271, 273, 275. The first gusset panel 271 is foldably connected to the second gusset panel 273 along an oblique fold line 277 and the third gusset panel 275 is foldably connected to the second gusset panel 273 along an oblique fold line 279. The gusset panels 271 and 275 have free edges 271*a* and 275*a* that extend obliquely from the edge of the panels 251 and 257, respectively. The gusset panel 273 may have a curved free edge 273*a* generally extending between the edges of the gusset panels 271 and 275. In one embodiment, the free edge 273*a* is generally convexly curved with respect to the first side panel 215.

In one embodiment, the second gusset 261 comprises three generally triangular gusset panels 281, 283, 285. The fourth gusset panel 281 is foldably connected to the fifth gusset panel 283 along an oblique fold line 287 and the sixth gusset panel 285 is foldably connected to the fifth gusset panel 283 along an oblique fold line 289. The gusset panels 281 and 285 may have free edges 281*a* and 285*a* that extend obliquely from the edge of the panel 251 and the edge of the attachment flap 265, respectively. The gusset panel 283 may have a curved free edge 283*a* generally extending between the edges of the gusset panels 281 and 285. In one embodiment, the free edge 283*a* is generally convexly curved with respect to the second side panel 223. The gussets 253, 261 could be otherwise shaped, arranged, and/or configured without departing from the disclosure.

The gussets 251, 253 are configured in this manner by selecting the angle θ of the fold lines 277, 279, 287, 289 defining the gusset panels 271, 273, 275, 281, 283, 285 to create a biasing force when the gussets 253, 261 are downwardly folded. As noted above, the angle θ may be between 40 to 45 degrees and in one embodiment, may be preferably between 40 to 43 degrees. For example and without limiting the scope of this disclosure, according to some embodiments, such as depicted in FIGS. 5-10, the angle θ is 40 degrees, but the angle θ could be more or less than shown and described without departing from this disclosure.

As illustrated in FIG. 5, the first top panel 251 includes an attachment portion 251*a* and a tear strip 254 similar to the corresponding features of the first embodiment. The tear strip 254 is defined by two tear lines 252, 256. The tear strip 254 comprises a tab 258 extending outwardly from the first top panel 251 toward the gusset 253. In one embodiment, the tear line 252 comprises two convex portions 252*a*, 252*b* and a concave portion 252*c* extending between the two convex portions 252*a*, 252*b*. The cut 252 may be alternatively shaped or arranged without departing from the disclosure. The second top panel 257 includes a free edge generally having two concave portions 257*a*, 257*b* and a convex curved portion 257*c* extending between the edges of the two concave portions 257*a*, 257*b*. The curved portions 257*a*, 257*b*, 257*c* generally corresponding to the curved portions 252*a*, 252*b*, 252*c* of the cut line 252. In the embodiment of FIG. 5, the attachment portion 251*a* and the tear strip 254 extend across less than the entire width of the first top panel 251.

Figure 7:
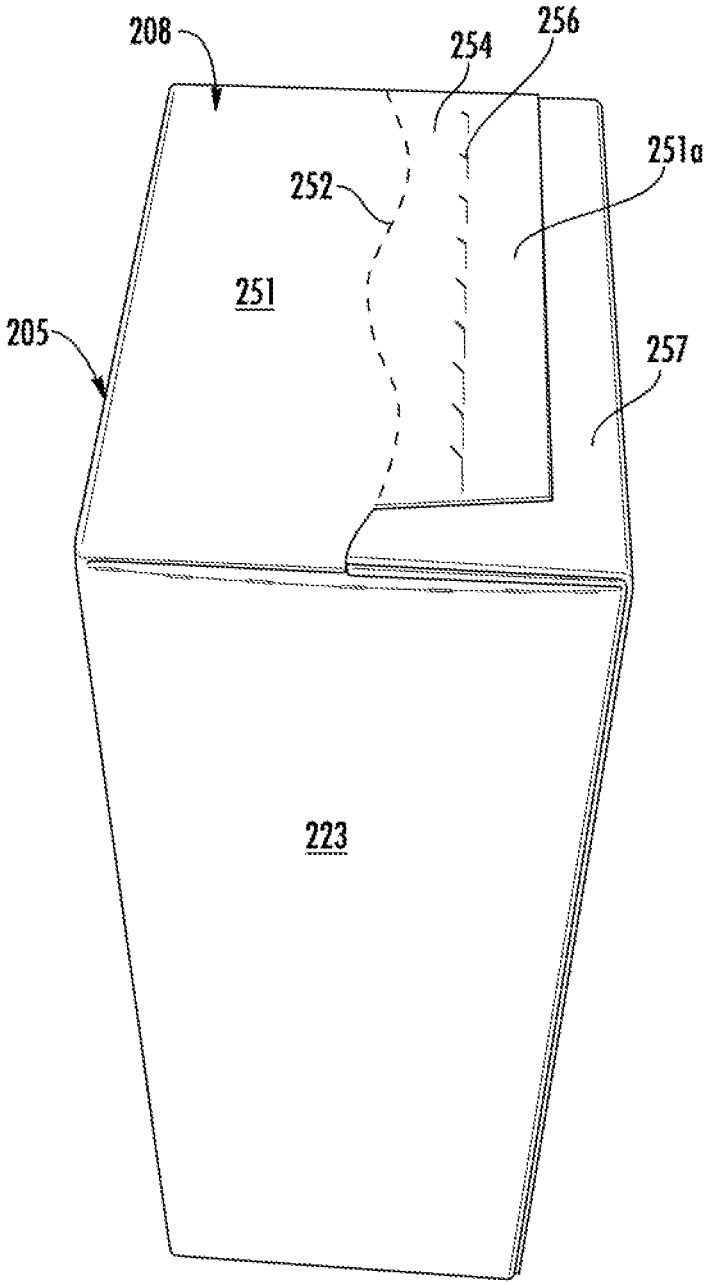
FIG. 7 is a perspective view of the carton of FIG. 5 in a closed position.

In one embodiment, the carton 205 is formed from the blank 203, in a similar manner as the carton 105 and blank 103 of the first embodiment. The reclosable top 208 of the carton 205 can be closed in a similar manner as the reclosable top 108 of the carton 105 of the first embodiment and as generally shown in FIGS. 6-10. The top 208 is closed by activating the gussets 253, 261 to downwardly fold the central gusset panel 273, 283 of each gusset 253, 261 relative to a respective side panel 215, 223, causing the downward folding of the panels 251, 257. The secondary gusset panels 275, 281 are overlapped and positioned in face-to-face contact or adjacent to the second end panel 257, and the secondary gusset panels 271, 285 are overlapped and positioned in face-to-face contact or adjacent to the first end panel 251. When the gussets 253, 261 are activated to close the top 208 of the carton 205, the first top panel 251 overlaps the second top panel 257 and the top panels 251, 257 are positioned in face-to-face contact to close the top of the carton (FIG. 7). The attachment portion 251*a* can be adhesively secured to the exterior surface of the top panel 257 at a location "g" (FIG. 5) with an adhesive such as glue.

Figure 8:
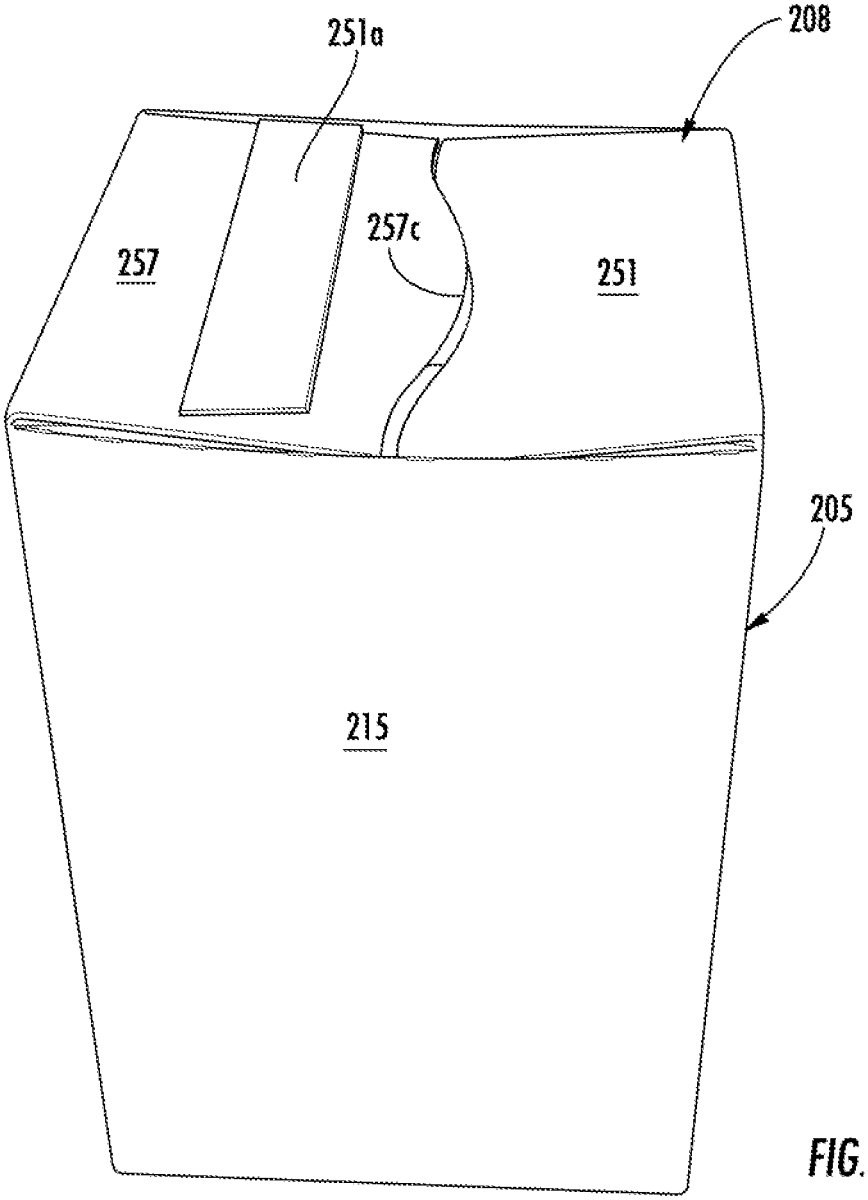
FIG. 8 is a perspective view of the carton of FIG. 5 in a closed position after the tear strip has been separated.
Figure 9:
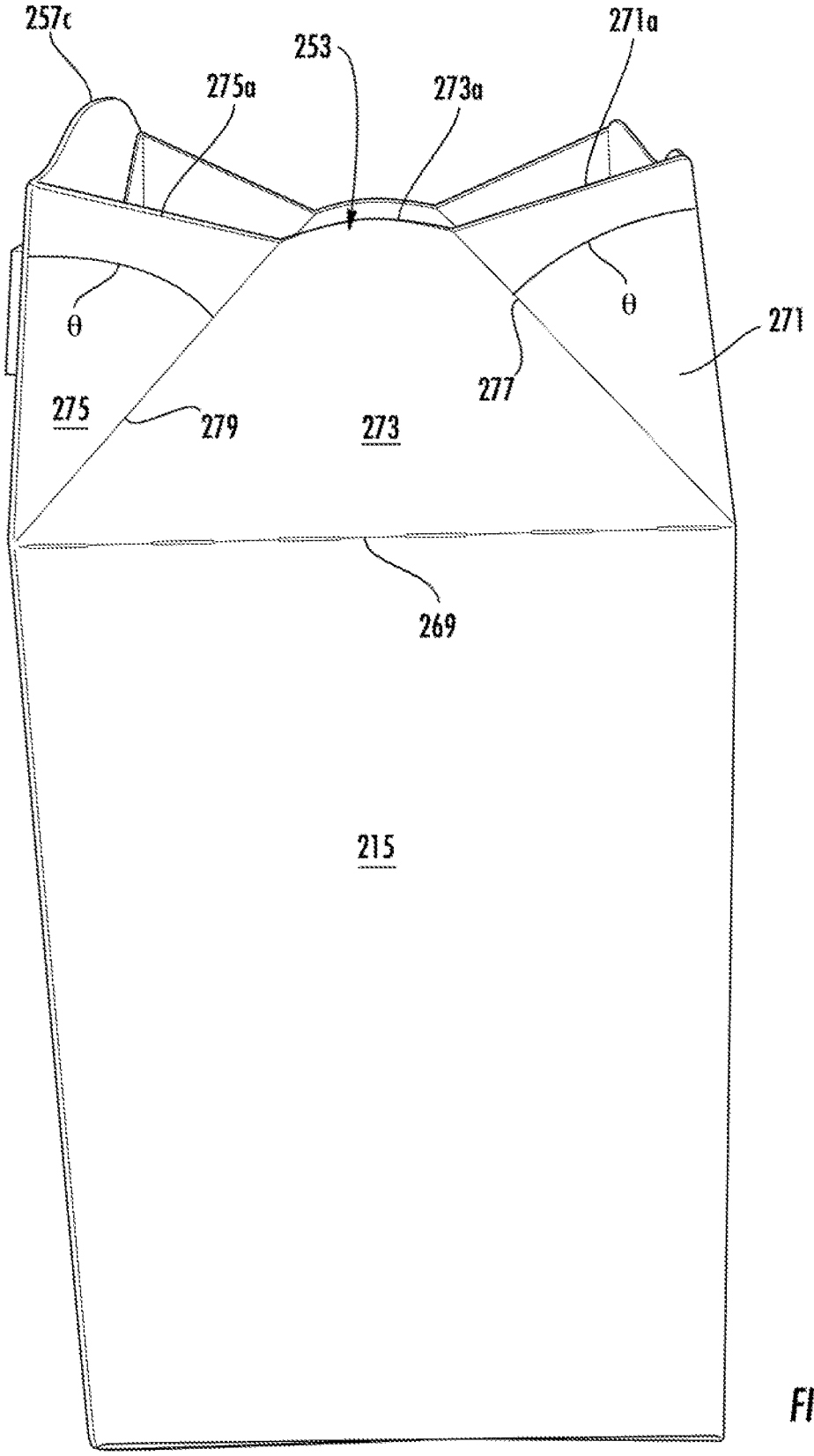
FIG. 9 is a perspective view of the carton of FIG. 5 in an open position after the tear strip has been separated.
Figure 10:
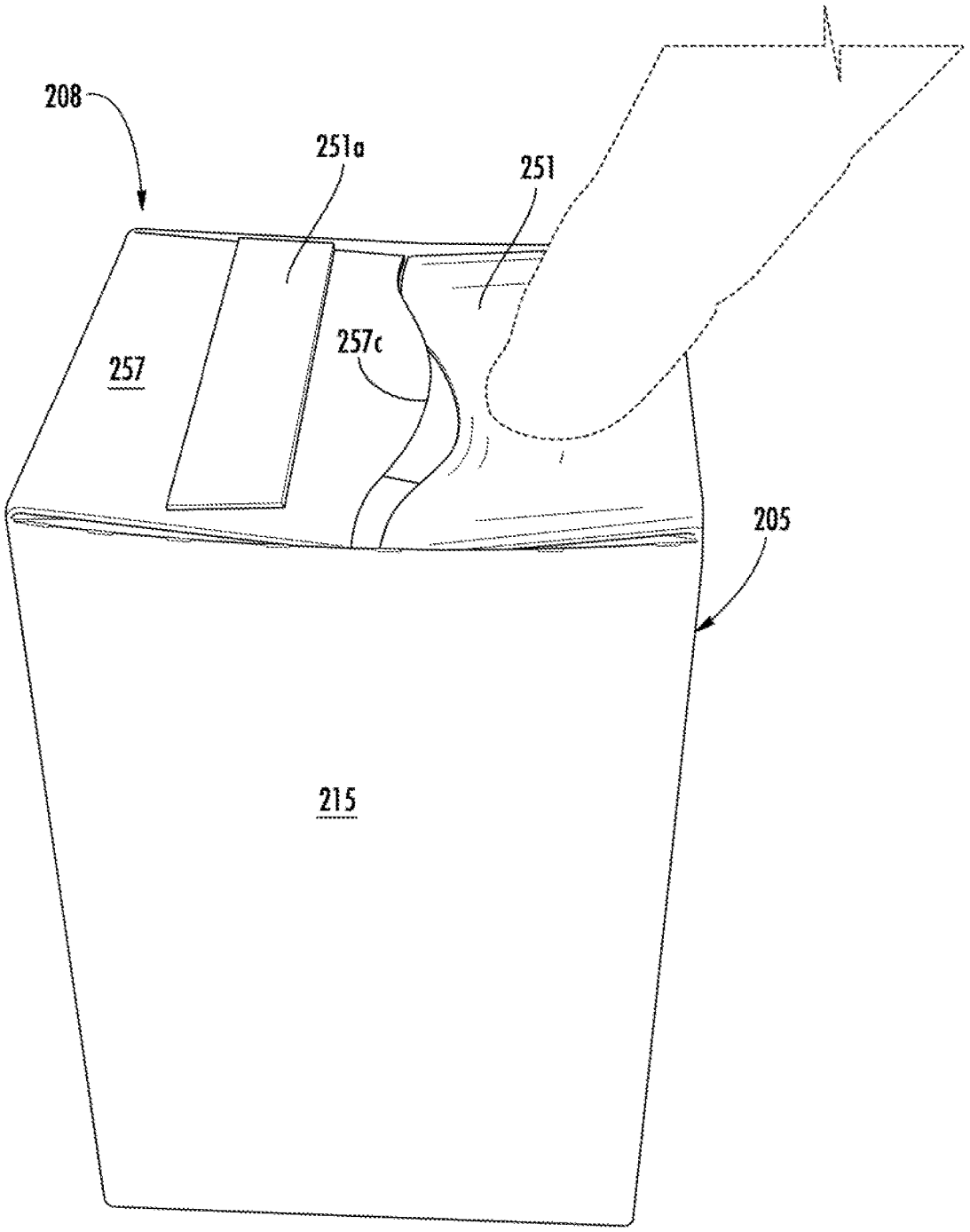
FIG. 10 is a perspective view of the carton of FIG. 5 in a closed position after the tear strip has been separated.

The carton 205 can be opened by pulling the tab 258 and separating the tear strip 254 from the carton 205 (FIG. 8). Pressure can be applied to panels 215, 223 with a user's hand to push the panels 215, 223 slightly inward causing the top 208 of the carton 205 to open. Alternatively, one of the edges of the top panels 251, 257 can be grasped to pull the first top panel 251 or the second top panel 257 upwardly opening the carton (FIG. 9). Articles such as food products may be removed from the carton. As illustrated in FIG. 10, the top 208 of the carton 205 can be reclosed and held in the closed position by pushing the top panel 257 downwardly, causing the gussets 253 and 261 and the opposite top end panel 251 to inwardly fold. Alternatively, the top 208 of the carton 205 can be reclosed by pushing the top panel 251 downwardly in a similar matter without departing for the disclosure.

Figure 11:
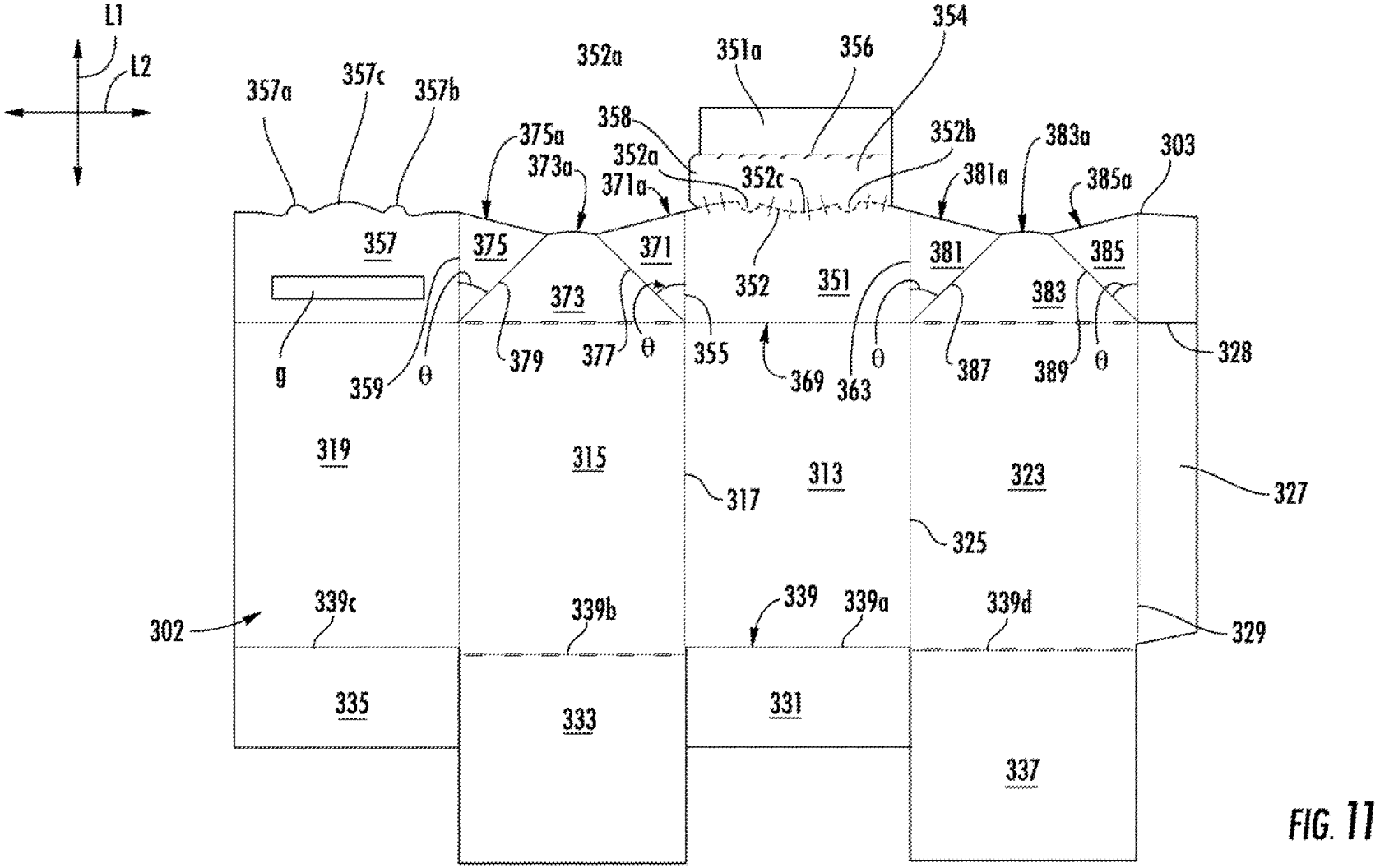
FIG. 11 is a plan view of an exterior surface of a blank for forming a carton according to a third embodiment of the disclosure.

FIG. 11 illustrates an exterior surface 302 of a blank 303 for forming a carton (not shown) according to a third embodiment of the disclosure. The third embodiment is generally similar to the first and second embodiments, except for variations noted and variations that will be apparent to one of ordinary skill in the art. Accordingly, similar or identical features of the embodiments have been given like or similar reference numbers. As shown in FIG. 11, the blank 303 has a longitudinal axis L1 and a lateral axis L2. The blank 303 includes a front panel 313 foldably connected to a first side panel 315 at a lateral fold line 317 and a second side panel 323 at a lateral fold line 325. A back panel 319 is foldably connected to the first side panel 315 at a lateral fold line 321.

As shown in FIG. 11, bottom end flaps 331, 333, 335, 337 are respectively foldably connected to a respective one of the front panel 313, first side panel 315, back panel 319, and second side panel 323. The bottom end flaps 331, 333, 335, 337 are foldably connected to respective panels 313, 315, 319, 323 at a marginal portion of the blank 303 by a longitudinal fold line 339. As illustrated in FIG. 11, the fold line 339 comprises respective offset folds lines 339*a*, 339*b*, 339*c*, 339*d* connecting the bottom end flaps 331, 333, 335, 335 to respective panels 313, 315, 319, 323.

In the illustrated embodiment, the blank 303 includes a first top panel 351 foldably connected to a first gusset 353 at a lateral fold line 355 and a second gusset 361 is foldably connected to the first top panel 351 at a lateral fold line 363. A second top panel 357 is foldably connected to the first gusset 353 at a lateral fold line 359. The flaps and gussets 351, 353, 357, 361 are foldably connected to respective panels 313, 315, 319, 323 at a marginal portion of the blank 303 by a longitudinal fold line 369. As shown in FIG. 11, an attachment flap 327 is foldably connected to the side panel 323 and gusset panel 385 along fold line 329. The attachment flap may comprise a partial cut 328 extending at least partially in the attachment flap 327. As illustrated in FIG. 11, the partial cut 328 is collinear with the fold line 369. In some embodiments, the longitudinal fold line 369 may include perforations.

In one embodiment, the first gusset 353 comprises three generally triangular gusset panels 371, 373, 375. The first gusset panel 371 is foldably connected to the second gusset panel 373 along an oblique fold line 377 and the third gusset panel 375 is foldably connected to the second gusset panel 373 along an oblique fold line 379. The gusset panels 371 and 375 may have free edges 371*a* and 375*a* that extend obliquely from the edge of the panels 351 and 357, respectively. The gusset panel 373 may have a curved free edge 373*a* generally extending between the edges of the gusset panels 371 and 375. In one embodiment, the free edge 373*a* is generally convexly curved with respect to the first side panel 315.

In one embodiment, the second gusset 361 comprises three generally triangular gusset panels 381, 383, 385. The fourth gusset panel 381 is foldably connected to the fifth gusset panel 383 along an oblique fold line 387 and the sixth gusset panel 385 is foldably connected to the fifth gusset panel 383 along an oblique fold line 389. The gusset panels 381 and 385 may have free edges 381*a* and 385*a* that extend obliquely from the edge of the panel 351 and the edge of the attachment flap 365, respectively. The gusset panel 383 may have a curved free edge 383*a* generally extending between the edges of the gusset panels 381 and 385. In one embodiment, the free edge 383*a* is generally convexly curved with respect to the second side panel 323. The gussets 353, 361 could be otherwise shaped, arranged, and/or configured without departing from the disclosure.

As illustrated in FIG. 11, the top panel 351 includes an attachment portion 351*a* and tear strip 354 define by tear lines 352, 356. The tear strip 354 may comprise a tab 358 extending outwardly from the first top panel 351 toward the gusset 353.

In one embodiment, the second top panel 357 has a free edge having convex curved projections 357*a*, 357*b* extending outwardly from the second top end panel 357. The flap 357 also includes a convex curved portion 357*c* extending between the projections 357*a*, 357*b*. The top panel 351 comprises a generally convex shaped cut 352 having concave portions 352*a*, 352*b*, 352*c* that correspond with the projections 357*a*, 357*b* and the curved portion 357*c* of the top back panel 357.

In one embodiment, the carton is formed from the blank 303, by folding the panels 313, 315, 319, 323 along fold lines 317, 321, 325 and adhesively attaching the adhesive flap 327, which is folded about the fold line 329, to the front panel 313 and to the second top panel 357. In one embodiment, the attachment flap 327 may be at least partially separated at the partial cut 328. The bottom of the carton can be closed by overlapping the bottom end flaps 331, 333, 335, 337. One or more of the bottom end flaps 331, 333, 335, 337 can be adhesively secured, for example, with glue without departing from the disclosure. The carton with open top can be filled an article or a plurality of articles (not shown) after closing the bottom or prior to closing the bottom without departing from the disclosure. The top of the carton can be closed in a similar manner as the carton of the first embodiment. The top is closed by activating the gussets 353, 361, in a similar manner as the first embodiment, to downwardly fold the central gusset panel 373, 383 of each gusset 353, 361 relative to a respective side panel 315, 323, causing the downward folding of the end panels 351, 357. The secondary gusset panels 375, 381 are overlapped and positioned in face-to-face contact or adjacent to the second top panel 357, and the secondary gusset panels 371, 385 are overlapped and positioned in face-to-face contact or adjacent to the first top end panel 351. When the gussets 353, 361 are activated to close the top of the carton, the first top panel 351 overlaps the second top panel 357 and the top panels 351, 357 are positioned in face-to-face contact to close the top of the carton. The attachment portion 351*a* can be adhesively secured to the exterior surface of the top panel 357 at a location "g" (FIG. 11) with an adhesive such as glue.

The carton can be opened by pulling the tab 358 and separating the tear strip 354 from the carton. Pressure can be applied to panels 315, 323 with a user's hand to push the panels 315, 323 slightly inward causing the top of the carton to open. Alternatively, one of the edges of the top flaps 351, 357 can be grasped to pull the first top panel 351 or second top panel 357 upwardly opening the carton. Articles such as food products may be removed from the carton. The top of the carton can be reclosed and held in the closed position by pushing the second top panel 357 downwardly, causing the gussets 353 and 361 and the opposite top end panel 351 to inwardly fold. When the reclosable top of the carton of the third embodiment is closed, the projections 357*a*, 357*b* and the convex curved portion 357*c* of the second top panel 357 and the concave indentations 352*a*, 352*b*, 352*c* of the first top panel 351 can interlock or at least partially engage to secure the first top panel 351 and the second top panel 357. Alternatively, the top of the carton can be reclosed by pushing the first top panel 351 and/or the second top panel 357 downwardly in a similar matter as set forth above for the other embodiments without departing for the disclosure.

Figure 12:
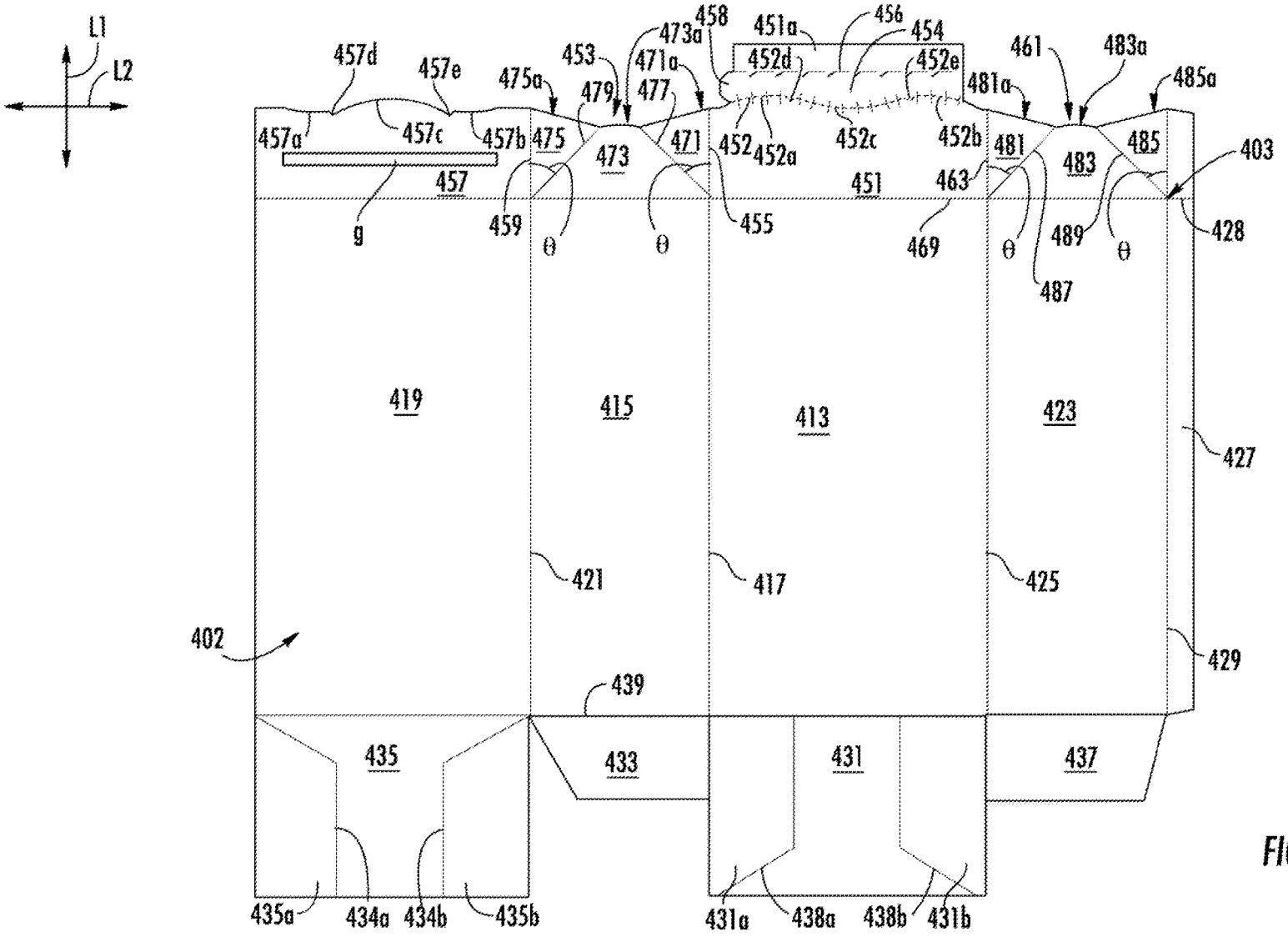
FIG. 12 is a plan view of an exterior surface of a blank for forming a carton according to a fourth embodiment of the disclosure.

FIG. 12 illustrates an exterior surface 402 of a blank 403 for forming a carton according to a fourth embodiment of the disclosure. The fourth embodiment is generally similar to the first, second, and third embodiment, except for variations noted and variations that will be apparent to one of ordinary skill in the art. Accordingly, similar or identical features of the embodiments have been given like or similar reference numbers. As shown in FIG. 12, the blank 403 has a longitudinal axis L1 and a lateral axis L2. The blank 403 includes a front panel 413 foldably connected to a first side panel 415 at a lateral fold line 417 and a second side panel 423 at a lateral fold line 425. A back panel 419 is foldably connected to the first side panel 415 at a lateral fold line 421.

As shown in FIG. 12, bottom end flaps 431, 433, 435, 437 are respectively foldably connected to a respective one of the front panel 413, first side panel 415, back panel 419, and second side panel 423. The bottom end flaps 431, 433, 435, 437 are foldably connected to respective panels 413, 415, 419, 423 at a marginal portion of the blank 403 by a longitudinal fold line 439. In one embodiment, the bottom panels 431, 435 have deboss or emboss portions 431*a*, 431*b*, 435*a*, 435*b* defined by lines of weakening 434*a*, 434*b*, 438*a*, 438*b*. The fold line 439 can be otherwise shaped or be offset at portions of the blank 403 without departing from the disclosure.

In the illustrated embodiment, the blank 403 includes a first top panel 451 foldably connected to a first gusset 453 at a lateral fold line 455 and a second gusset 461 is foldably connected to the first top panel 451 at a lateral fold line 463. A second top panel 457 is foldably connected to the first gusset 453 at a lateral fold line 459. The flaps and gussets 451, 453, 457, 461 are foldably connected to respective panels 413, 415, 419, 423 at a marginal portion of the blank 403 by a longitudinal fold line 469. As shown in FIG. 12, an attachment flap 427 is foldably connected to the side panel 423 and gusset panel 485 along fold line 429. The attachment flap may comprise a partial cut 428 extending at least partially in the attachment flap 427. As illustrated in FIG. 12, the partial cut 428 is collinear with the fold line 469. In some embodiments, the longitudinal fold line 469 may include perforations.

In one embodiment, the first gusset 453 comprises three generally triangular gusset panels 471, 473, 475. The first gusset panel 471 is foldably connected to the second gusset panel 473 along an oblique fold line 477 and the third gusset panel 475 is foldably connected to the second gusset panel 473 along an oblique fold line 479. The gusset panels 471 and 475 may have free edges 471*a* and 475*a* that extend obliquely from the edge of the panels 451 and 457, respectively. The gusset panel 473 may have a curved free edge 473*a* generally extending between the edges of the gusset panels 471 and 475. In one embodiment, the free edge 473*a* is generally convexly curved with respect to the first side panel 415.

In one embodiment, the second gusset 461 comprises three generally triangular gusset panels 481, 483, 485. The fourth gusset panel 481 is foldably connected to the fifth gusset panel 483 along an oblique fold line 487 and the sixth gusset panel 485 is foldably connected to the fifth gusset panel 483 along an oblique fold line 489. The gusset panels 481 and 485 may have free edges 481*a* and 485*a* that extend obliquely from the edge of the panel 451 and the edge of the attachment flap 465, respectively. The gusset panel 483 may have a curved free edge 483*a* generally extending between the edges of the gusset panels 481 and 485. In one embodiment, the free edge 483*a* is generally convexly curved with respect to the second side panel 423. The gussets 453, 461 could be otherwise shaped, arranged, and/or configured without departing from the disclosure.

As illustrated in FIG. 12, the first top panel 451 includes an attachment portion 451*a* and a tear strip 454 defined by two tear lines 452, 456. The tear strip 454 may comprise a tab 458 extending outwardly from the first top panel toward the gusset 453. In one embodiment, the cut line 452 comprises two convex portions 452*a*, 452*b*, and concave portions 452*c*, 452*d*, 452*e* extending between the two convex portions 452*a*, 452*b*. The tear line 452 may be alternatively shaped or arranged without departing from the disclosure. The second top panel 457 includes a free edge generally having concave portions 457*a*, 457*b*, 457*d*, 457*e* and a convex curved portion 457*c* extending between the edges of the two concave portions 457*d*, 457*e*. The curved portions 457*a*, 457*b*, 457*c*, 457*d*, 457*e* generally correspond to the curved portions 452*a*, 452*b*, 452*c*, 452*d*, 452*e* of the tear line 452.

In one embodiment, the carton is formed from the blank 403, by folding the panels 413, 415, 419, 423 along fold lines 417, 421, 425 and adhesively attaching the adhesive flap 427, that is folded about the fold line 429, to the front panel 413 and also adhesively attaching the attachment flap 465 to the second top panel 457. The bottom of the carton can be closed by overlapping the bottom end flaps 431, 433, 435, 437. One or more of the bottom end flaps 431, 433, 435, 437 can be adhesively secured, for example, with glue without departing from the disclosure. The carton with open top can be filled an article or a plurality of articles (not shown) after closing the bottom or prior to closing the bottom without departing from the disclosure. The top of the carton can be closed in a similar manner as the carton of the first embodiment. The top is closed by activating the gussets 453, 461 to downwardly fold the central gusset panel 473, 483 of each gusset 453, 461 relative to a respective side panel 415, 423, causing the downward folding of the end panels 451, 457. The secondary gusset panels 475, 481 are overlapped and positioned in face-to-face contact or adjacent to the second top end panel 457, and the secondary gusset panels 471, 485 are overlapped and positioned in face-to-face contact or adjacent to the first top panel 451. When the gussets 453, 461 are activated to close the top of the carton, the first top panel 451 overlaps the second top panel 457 and the top panels 451, 427 are positioned in face-to-face contact to close the top of the carton. The attachment portion 451*a* can be adhesively secured to the exterior surface of the top panel 457 at a location "g" (FIG. 12) with an adhesive such as glue.

The carton can be opened by pulling the tab 458 and separating the tear strip 454 from the carton. Pressure can be applied to panels 415, 423 with a user's hand to push the panels 415, 423 slightly inward causing the top of the carton to open. Alternatively, one of the edges of the top flaps 451, 457 can be grasped to pull the first top panel 451 or second top panel 457 upwardly opening the carton. Articles such as food products may be removed from the carton. The top of the carton can be reclosed and held in the closed position by pushing the second top panel 457 downwardly, causing the gussets 453 and 461 and the opposite top end panel 451 to inwardly fold. Alternatively, the top of the carton can be reclosed by pushing the first top panel 451 downwardly in a similar matter without departing for the disclosure. When the reclosable top of the carton of the fourth embodiment is closed, the concave portions 457*a*, 457*b*, 457*d*, 457*e* and the convex curved portion 457*c* of the second top panel 457 and the curved portions 452*a*, 452*b*, 452*c*, 452*d*, 452*e* of the first top panel 451 can interlock or at least partially engage to secure the first top panel 451 and the second top panel 457. Alternatively, the top of the carton can be reclosed by pushing the first top panel 451 and/or the second top panel 457 downwardly in a similar matter as set forth above for the other embodiments without departing for the disclosure.

Figure 13:
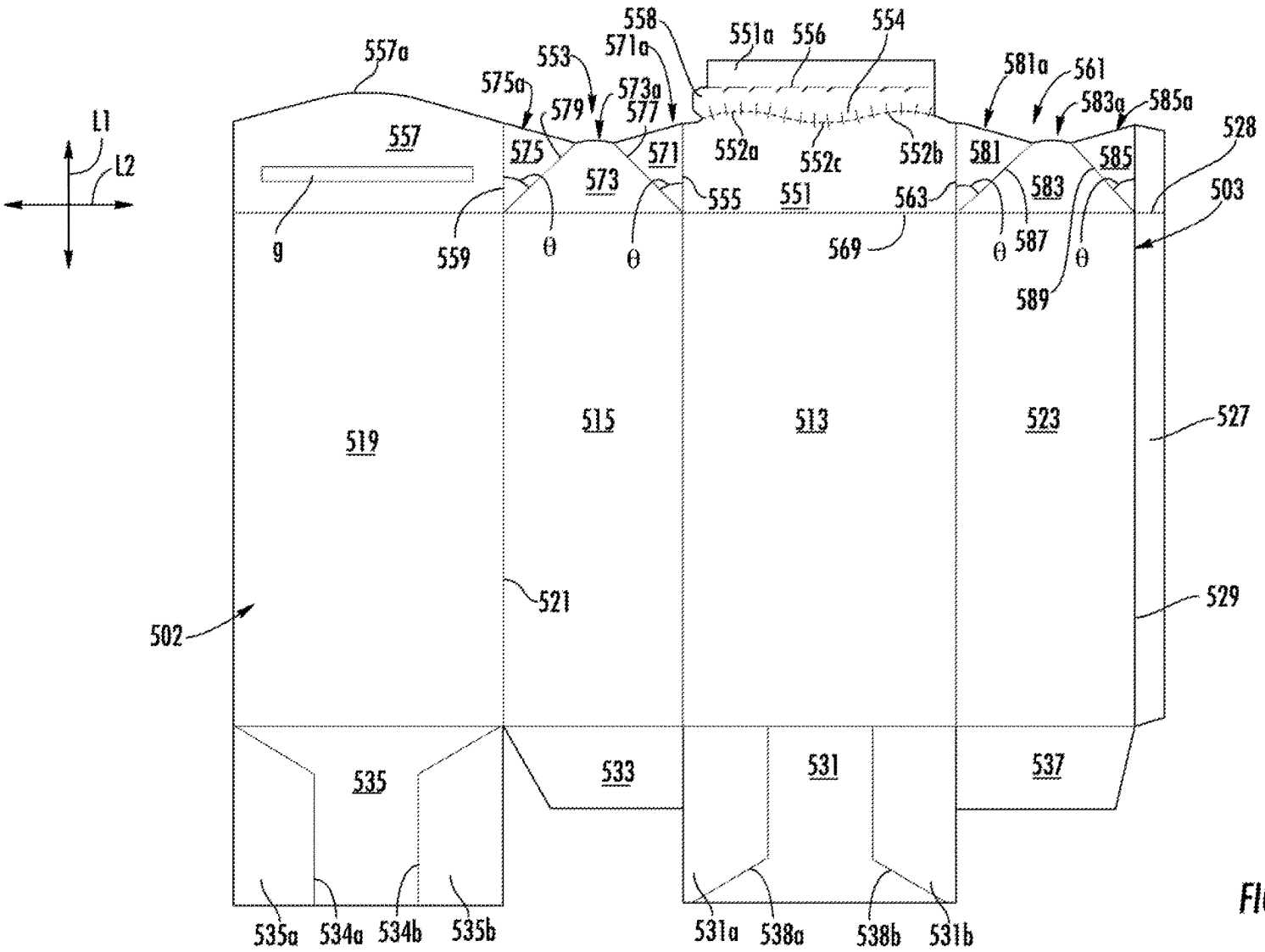
FIG. 13 is a plan view of an exterior surface of a blank for forming a carton according a fifth embodiment of the disclosure.

FIG. 13 illustrates an exterior surface 502 of a blank 503 for forming a carton (not shown) according to a fourth embodiment of the disclosure. The fourth embodiment is generally similar to the first, second, and third embodiment, except for variations noted and variations that will be apparent to one of ordinary skill in the art. Accordingly, similar or identical features of the embodiments have been given like or similar reference numbers. As shown in FIG. 13, the blank 503 has a longitudinal axis L1 and a lateral axis L2. The blank 503 includes a front panel 513 foldably connected to a first side panel 515 at a lateral fold line 517 and a second side panel 523 at a lateral fold line 525. A back panel 519 is foldably connected to the first side panel 515 at a lateral fold line 521.

As shown in FIG. 13, bottom end flaps 531, 533, 535, 537 are respectively foldably connected to a respective one of the front panel 513, first side panel 515, back panel 519, and second side panel 523. The bottom end flaps 531, 533, 535, 537 are foldably connected to respective panels 513, 515, 519, 523 at a marginal portion of the blank 503 by a longitudinal fold line 539. In one embodiment, the bottom panels 531, 535 have deboss or emboss portions 531*a*, 531*b*, 535*a*, 535*b* defined by lines of weakening 534*a*, 534*b*, 538*a*, 538*b*. The fold line 539 can be otherwise shaped or be offset at portions of the blank 503 without departing from the disclosure.

In the illustrated embodiment, the blank 503 includes a first top panel 551 foldably connected to a first gusset 553 at a lateral fold line 555 and a second gusset 561 is foldably connected to the first top panel 551 at a lateral fold line 563. A second top panel 557 is foldably connected to the first gusset 553 at a lateral fold line 559. The flaps and gussets 551, 553, 557, 561 are foldably connected to respective panels 513, 515, 519, 523 at a marginal portion of the blank 503 by a longitudinal fold line 569. As shown in FIG. 13, an attachment flap 527 is foldably connected to the side panel 523 and gusset panel 585 along fold line 529. The attachment flap may comprise a partial cut 528 extending at least partially in the attachment flap 527. As illustrated in FIG. 13, the partial cut 528 is collinear with the fold line 569. In some embodiments, the longitudinal fold line 569 may include perforations.

In one embodiment, the first gusset 553 comprises three generally triangular gusset panels 571, 573, 575. The first gusset panel 571 is foldably connected to the second gusset panel 573 along an oblique fold line 577 and the third gusset panel 575 is foldably connected to the second gusset panel 573 along an oblique fold line 579. The gusset panels 571 and 575 may have free edges 571*a* and 575*a* that extend obliquely from the edge of the panels 551 and 557, respectively. The gusset panel 573 may have a curved free edge 573*a* generally extending between the edges of the gusset panels 571 and 575. In one embodiment, the free edge 573*a* is generally convexly curved with respect to the first side panel 515.

In one embodiment, the second gusset 561 comprises three generally triangular gusset panels 581, 583, 585. The fourth gusset panel 581 is foldably connected to the fifth gusset panel 583 along an oblique fold line 587 and the sixth gusset panel 585 is foldably connected to the fifth gusset panel 583 along an oblique fold line 589. The gusset panels 581 and 585 may have free edges 581*a* and 585*a* that extend obliquely from the edge of the panel 551 and the edge of the attachment flap 565, respectively. The gusset panel 583 may have a curved free edge 583*a* generally extending between the edges of the gusset panels 581 and 585. In one embodiment, the free edge 583*a* is generally convexly curved with respect to the second side panel 523. The gussets 553, 561 could be otherwise shaped, arranged, and/or configured without departing from the disclosure.

As illustrated in FIG. 13, the first top panel 551 includes an attachment portion 551*a* and a tear strip 554 defined by two tear lines 552, 556. The tear strip 554 comprises a tab 558 extending outwardly from the first top panel 451 toward the gusset 553. In one embodiment, the tear line 552 comprises two convex portions 552*a*, 552*b*, and a concave portions 552*c* extending between the two convex portions 552*a*, 552*b*. The tear line 552 may be alternatively shaped or arranged without departing from the disclosure. The second top panel 557 includes a generally convex free edge 557*a*. The convex free edge 557*a* generally corresponds to the curved portions 552*a*, 552*b*, 552*c*, of the cut line 552.

In one embodiment, the carton is formed from the blank 503, in a similar manner as described above for the previous embodiments. For example, the panels 513, 515, 519, 523 are folded along fold lines 517, 521, 525 and the adhesive flap 527 is folded about the fold line 529 and adhesively attached to the front panel 513. The attachment flap 565 is adhesively attached to the second top panel 557. The bottom of the carton can be closed by overlapping the bottom end flaps 531, 533, 535, 537. One or more of the bottom end flaps 531, 533, 535, 537 can be adhesively secured, for example, with glue without departing from the disclosure. The carton with open top can be filled an article or a plurality of articles (not shown) after closing the bottom or prior to closing the bottom without departing from the disclosure. The reclosable top of the carton can be closed in a similar manner as the carton of the first, second, third, and fourth embodiments. The top is closed by activating the gussets 553, 561 to downwardly fold the central gusset panel 573, 583 of each gusset 553, 561 relative to a respective side panel 515, 523, causing the downward folding of the top end panels 551, 557. The secondary gusset panels 575, 581 are overlapped and positioned in face-to-face contact or adjacent to the second top panel 557, and the secondary gusset panels 571, 585 are overlapped and positioned in face-to-face contact or adjacent to the first top end panel 551. When the gussets 553, 561 are activated to close the top of the carton, the first top panel 551 overlaps the second top panel 557 and the top panels 551, 557 are positioned in face-to-face contact to close the top of the carton. The attachment portion 551*a* can be adhesively secured to the exterior surface of the top panel 557 at a location "g" (FIG. 13) with an adhesive such as glue.

The carton can be opened by pulling the tab 558 and separating the tear strip 554 from the carton. Pressure can be applied to panels 515, 523 with a user's hand to push the panels 515, 523 slightly inward causing the top of the carton to open. Alternatively, one of the edges of the top flaps 551, 557 can be grasped to pull the first top panel 551 or second top panel 557 upwardly opening the carton. Articles such as food products may be removed from the carton. The top of the carton can be reclosed and held in the closed position in a similar manner as the previous embodiments by pushing the second top panel 557 downwardly, causing the gussets 553 and 561 and the opposite top end panel 551 to inwardly fold. Alternatively, the top of the carton can be reclosed by pushing the first top panel 551 downwardly in a similar matter without departing for the disclosure.

The blanks according to the present disclosure can be, for example, formed from coated paperboard and similar materials. For example, the interior and/or exterior sides of the blanks can be coated with a clay coating. The clay coating may then be printed over with product, advertising, price coding, and other information or images. The blanks may then be coated with a varnish to protect any information printed on the blank. The blanks may also be coated with, for example, a moisture barrier layer, on either or both sides of the blank. In accordance with the above-described embodiments, the blanks may be constructed of paperboard of a caliper such that it is heavier and more rigid than ordinary paper. The blanks can also be constructed of other materials, such as cardboard, hard paper, or any other material having properties suitable for enabling the carton to function at least generally as described herein. The blanks can also be laminated or coated with one or more sheet-like materials at selected panels or panel sections.

In accordance with the above-described embodiments of the present disclosure, a fold line can be any substantially linear, although not necessarily straight, form of weakening that facilitates folding there along. More specifically, but not for the purpose of narrowing the scope of the present disclosure, fold lines include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

The above embodiments may be described as having one or more panels adhered together by glue during erection of the carton embodiments. The term "glue" is intended to encompass all manner of adhesives commonly used to secure carton panels in place.

The foregoing description of the disclosure illustrates and describes various exemplary embodiments. Various additions, modifications, changes, etc., could be made to the exemplary embodiments without departing from the spirit and scope of the disclosure. It is intended that all matter contained in the above description or shown in the accompanying drawings shall be interpreted as illustrative and not in a limiting sense. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carton for holding at least one article, the carton comprising:

a plurality of panels extending at least partially around an interior of the carton, the plurality of panels comprising a front panel, a first side panel, a second side panel, and a back panel;

a reclosable top comprising a first top panel foldably connected to the front panel at a fold line, a second top panel foldably connected to the back panel at a fold line, a first gusset foldably connected to the first side panel, and a second gusset foldably connected to the second side panel, each of the first gusset and the second gusset are respectively foldably connected to the first top panel and the second top panel, the reclosable top is positionable between a closed position, wherein the first top panel and the second top panel are downwardly folded at the respective fold line and positioned generally perpendicular to the respective front panel and back panel to at least partially close the interior of the carton, and an open position wherein the first top panel and the second top panel allow access to the interior of the carton, the first gusset and the second gusset have closure features biasing the first top panel and the second top panel to the closed position.

2. The carton of claim 1, further comprising a plurality of bottom end flaps respectively foldably connected to the plurality of panels for closing a bottom end of the carton.

3. The carton of claim 1, wherein, in the closed position, the first top panel and the second top panel are in at least partial face-to-face contact.

4. A carton for holding at least one article, the carton comprising:

a plurality of panels extending at least partially around an interior of the carton, the plurality of panels comprising a front panel, a first side panel, a second side panel, and a back panel;

a reclosable top comprising a first top panel foldably connected to the front panel at a fold line, a second top panel foldably connected to the back panel at a fold line, a first gusset foldably connected to the first side panel, and a second gusset foldably connected to the second side panel, the first gusset comprises a first gusset panel, a second gusset panel, and a third gusset panel, the first gusset panel being foldably connected to the second gusset panel along a first oblique fold line, and the third gusset panel being foldably connected to the second gusset panel along a second oblique fold line, the second gusset comprises a fourth gusset panel, a fifth gusset panel, and a sixth gusset panel, the fourth gusset panel being foldably connected to the fifth gusset panel along a third oblique fold line and the sixth gusset panel being foldably connected to the fifth gusset panel along a fourth oblique fold line, each of the first gusset and the second gusset are respectively foldably connected to the first top panel and the second top panel, the second gusset panel is foldably connected to the first side panel at a first longitudinal fold line and the fifth gusset panel is foldably connected to the second side panel at a second longitudinal fold line;

the reclosable top is positionable between a closed position wherein the first top panel and the second top panel are downwardly folded at the respective fold line to at least partially close the interior of the carton and an open position wherein the first top panel and the second top panel allow access to the interior of the carton, the first gusset and the second gusset have closure features biasing the first top panel and the second top panel to the closed position.

5. The carton of claim 4, wherein the first gusset panel is foldably connected to the first top panel at a first lateral fold line and the third gusset panel is foldably connected to the second top panel at a second lateral fold line.

6. The carton of claim 5, wherein the first lateral fold line and the first oblique fold line intersect at a first angle, the first angle is less than 45°.

7. The carton of claim 6, wherein the first angle is in the range of approximately 40° to approximately 43°.

8. The carton of claim 5, wherein the second lateral fold line and the second oblique fold line intersect at a second angle, the second angle is less than 45°.

9. The carton of claim 8, wherein the second angle is in the range of approximately 40° to approximately 43°.

10. A carton for holding at least one article, the carton comprising:

a plurality of panels extending at least partially around an interior of the carton, the plurality of panels comprising a front panel, a first side panel, a second side panel, and a back panel;

a reclosable top comprising a first top panel foldably connected to the front panel, a second top panel foldably connected to the back panel, a first gusset foldably connected to the first side panel, and a second gusset foldably connected to the second side panel, each of the first gusset and the second gusset are respectively foldably connected to the first top panel and the second top panel, the reclosable top is positionable between a closed position wherein the first top panel and the second top panel are downwardly folded to at least partially close the interior of the carton and an open position wherein the first top panel and the second top panel allow access to the interior of the carton, the first gusset and the second gusset have closure features biasing the first top panel and the second top panel to the closed position, and the first top panel comprises a removable tear strip adjacent an attachment portion for adhesive attachment to the second top panel to secure the reclosable top in the closed position, the removable tear strip being separable from the attachment portion to release the first top panel from attachment to the second top panel and allow the first top panel and second top panel to be positioned in the open position.

11. The carton of claim 10, wherein the removable tear strip extends across less than the entire width of the first top panel.

12. A blank for forming a carton for holding at least one article, the blank comprising:

a plurality of panels comprising a front panel, a first side panel, a second side panel, and a back panel, the plurality of panels being for forming an interior of the carton formed from the blank;

reclosable features for forming a reclosable top of the carton formed from the blank, the reclosable features comprising a first top panel foldably connected to the front panel at a fold line, a second top panel foldably connected to the back panel at a fold line, a first gusset foldably connected to the first side panel, and a second gusset foldably connected to the second side panel, each of the first gusset and the second gusset are respectively foldably connected to the first top panel and the second top panel, the reclosable top is positionable between a closed position, wherein the first top panel and the second top panel are downwardly folded at the respective fold line and positioned generally perpendicular to the respective front panel and back panel to at least partially close the interior of the carton formed from the blank, and an open position wherein the first top panel and the second top panel are positioned allow access to the interior of the carton formed from the blank, the first gusset and the second gusset have closure features biasing the first top panel and the second top panel to the closed position in the carton formed from the blank.

13. The blank of claim 12, further comprising a plurality of bottom end flaps respectively foldably connected to the plurality of panels for closing a bottom end of the carton formed from the blank.

14. The blank of claim 12, wherein, in the closed position of the carton formed from the blank, the first top panel and the second top panel are in at least partial face-to-face contact.

15. A blank for forming a carton for holding at least one article, the blank comprising:

a plurality of panels comprising a front panel, a first side panel, a second side panel, and a back panel, the plurality of panels being for forming an interior of the carton formed from the blank;

reclosable features for forming a reclosable top of the carton formed from the blank, the reclosable features comprising a first top panel foldably connected to the front panel at a fold line, a second top panel foldably connected to the back panel at a fold line, a first gusset foldably connected to the first side panel, and a second gusset foldably connected to the second side panel, each of the first gusset and the second gusset are respectively foldably connected to the first top panel and the second top panel, the first gusset comprises a first gusset panel, a second gusset panel, and a third gusset panel, the first gusset panel being foldably connected to the second gusset panel along a first oblique fold line, and the third gusset panel being foldably connected to the second gusset panel along a second oblique fold line, the second gusset comprises a fourth gusset panel, a fifth gusset panel, and a sixth gusset panel, the fourth gusset panel being foldably connected to the fifth gusset panel along a third oblique fold line and the sixth gusset panel being foldably connected to the fifth gusset panel along a fourth oblique fold line, the second gusset panel is foldably connected to the first side panel at a first longitudinal fold line and the fifth gusset panel is foldably connected to the second side panel at a second longitudinal fold line, the reclosable top is positionable between a closed position wherein the first top panel and the second top panel are downwardly folded at the respective fold line to at least partially close the interior of the carton formed from the blank and an open position wherein the first top panel and the second top panel are positioned allow access to the interior of the carton formed from the blank, the first gusset and the second gusset have closure features biasing the first top panel and the second top panel to the closed position in the carton formed from the blank.

16. The blank of claim 15, wherein the first gusset panel is foldably connected to the first top panel at a first lateral fold line and the third gusset panel is foldably connected to the second top panel at a second lateral fold line.

17. The blank of claim 16, wherein the first lateral fold line and the first oblique fold line intersect at a first angle, the first angle is less than 45°.

18. The blank of claim 17, wherein the first angle is in the range of approximately 40° to approximately 43°.

19. The blank of claim 16, wherein the second lateral fold line and the second oblique fold line intersect at a second angle, the second angle is less than 45°.

20. The blank of claim 19, wherein the second angle is in the range of approximately 40° to approximately 43°.

21. A blank for forming a carton for holding at least one article, the blank comprising:

a plurality of panels comprising a front panel, a first side panel, a second side panel, and a back panel, the plurality of panels being for forming an interior of the carton formed from the blank;

reclosable features for forming a reclosable top of the carton formed from the blank, the reclosable features comprising a first top panel foldably connected to the front panel, a second top panel foldably connected to the back panel, a first gusset foldably connected to the first side panel, and a second gusset foldably connected to the second side panel, each of the first gusset and the second gusset are respectively foldably connected to the first top panel and the second top panel, the reclosable top is positionable between a closed position wherein the first top panel and the second top panel are downwardly folded to at least partially close the interior of the carton formed from the blank and an open position wherein the first top panel and the second top panel are positioned allow access to the interior of the carton formed from the blank, the first gusset and the second gusset have closure features biasing the first top panel and the second top panel to the closed position in the carton formed from the blank, and the first top panel comprises a removable tear strip adjacent an attachment portion for adhesive attachment to the second top panel to secure the reclosable top in the closed position in the carton formed from the blank, the removable tear strip being separable from the attachment portion to release the first top panel from attachment to the second top panel and allow the first top panel and second top panel to be positioned in the open position in the carton formed from the blank.

22. The blank of claim 21, wherein the removable tear strip extends across less than the entire width of the first top panel.

23. A method of forming a carton for holding at least one article, the method comprising:

obtaining a blank comprising a plurality of panels, the plurality of panels comprising a front panel, a first side panel, a second side panel, and a back panel, reclosable features for forming a reclosable top, the reclosable features comprising a first top panel foldably connected to the front panel at a fold line, a second top panel foldably connected to the back panel at a fold line, a first gusset foldably connected to the first side panel, and a second gusset foldably connected to the second side panel, each of the first gusset and the second gusset are respectively foldably connected to the first top panel and the second top panel;

positioning the plurality of panels to form an interior of the carton;

positioning the reclosable features to form the reclosable top, the reclosable top is positionable between a closed position, wherein the first top panel and the second top panel are downwardly folded at the respective fold line and positioned generally perpendicular to the respective front panel and back panel to at least partially close the interior of the carton, and an open position wherein the first top panel and the second top panel allow access to the interior of the carton;

the first gusset and the second gusset have closure features biasing the first top panel and the second top panel to the closed position of the reclosable top.

24. The method of claim 23, further comprising activating the closure features and positioning the reclosable top to the closed position.

25. A method of forming a carton for holding at least one article, the method comprising:

obtaining a blank comprising a plurality of panels, the plurality of panels comprising a front panel, a first side panel, a second side panel, and a back panel, reclosable features for forming a reclosable top, the reclosable features comprising a first top panel foldably connected to the front panel at a fold line, a second top panel foldably connected to the back panel at a fold line, a first gusset foldably connected to the first side panel, and a second gusset foldably connected to the second side panel, each of the first gusset and the second gusset are respectively foldably connected to the first top panel and the second top panel, the first gusset comprises a first gusset panel, a second gusset panel, and a third gusset panel, the first gusset panel being foldably connected to the second gusset panel along a first oblique fold line, and the third gusset panel being foldably connected to the second gusset panel along a second oblique fold line, the second gusset comprises a fourth gusset panel, a fifth gusset panel, and a sixth gusset panel, the fourth gusset panel being foldably connected to the fifth gusset panel along a third oblique fold line and the sixth gusset panel being foldably connected to the fifth gusset panel along a fourth oblique fold line, the second gusset panel is foldably connected to the first side panel at a first longitudinal fold line and the fifth gusset panel is foldably connected to the second side panel at a second longitudinal fold line, positioning the plurality of panels to form an interior of the carton;

positioning the reclosable features to form the reclosable top, the reclosable top is positionable between a closed position wherein the first top panel and the second top panel are downwardly folded at the respective fold line to at least partially close the interior of the carton and an open position wherein the first top panel and the second top panel allow access to the interior of the carton.

26. The method of claim 25, wherein the first gusset panel is foldably connected to the first top panel at a first lateral fold line and the third gusset panel is foldably connected to the second top panel at a second lateral fold line.

27. The method of claim 26, wherein the first lateral fold line and the first oblique fold line intersect at a first angle, the first angle is less than 45°.

28. The method of claim 27, wherein the first angle is in the range of approximately 40° to approximately 43°.

29. The method of claim 26, wherein the second lateral fold line and the second oblique fold line intersect at a second angle, the second angle is less than 45°.

30. The method of claim 29, wherein the second angle is in the range of approximately 40° to approximately 43°.

31. A method of forming a carton for holding at least one article, the method comprising:

obtaining a blank comprising a plurality of panels, the plurality of panels comprising a front panel, a first side panel, a second side panel, and a back panel, reclosable features for forming a reclosable top, the reclosable features comprising a first top panel foldably connected to the front panel, a second top panel foldably connected to the back panel, a first gusset foldably connected to the first side panel, and a second gusset foldably connected to the second side panel, each of the first gusset and the second gusset are respectively foldably connected to the first top panel and the second top panel, the first top panel comprises an attachment portion and a removable tear strip adjacent the attachment portion, the removable tear strip being separable from the attachment portion;

positioning the plurality of panels to form an interior of the carton;

positioning the reclosable features to form the reclosable top, the reclosable top is positionable between a closed position wherein the first top panel and the second top panel are downwardly folded at the respective fold line to at least partially close the interior of the carton and an open position wherein the first top panel and the second top panel allow access to the interior of the carton;

the first gusset and the second gusset have closure features biasing the first top panel and the second top panel to the closed position of the reclosable top;

closing the reclosable top and adhesively attaching the attachment portion to the second top panel to secure the reclosable top in the closed position; and separating the removable tear strip from the attachment portion to release the first top panel from attachment to the second top panel and positioning the reclosable top to the open position.

32. The method of claim 31, further comprising positioning the reclosable top to the closed position by activating the closure features.

* * * * *